US012270120B2

(12) United States Patent
Tomita et al.

(10) Patent No.: US 12,270,120 B2
(45) Date of Patent: Apr. 8, 2025

(54) PLATING APPARATUS AND PLATING METHOD

(71) Applicant: EBARA CORPORATION, Tokyo (JP)

(72) Inventors: Masaki Tomita, Tokyo (JP); Masaya Seki, Tokyo (JP); Masashi Shimoyama, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 634 days.

(21) Appl. No.: 17/539,543

(22) Filed: Dec. 1, 2021

(65) Prior Publication Data

US 2022/0178046 A1 Jun. 9, 2022

(30) Foreign Application Priority Data

Jul. 20, 2021 (JP) ..... 2021-119338

(51) Int. Cl.

| | |
|---|---|
| ***C25D 17/00*** | (2006.01) |
| ***C25D 17/02*** | (2006.01) |
| ***C25D 17/06*** | (2006.01) |
| ***C25D 17/10*** | (2006.01) |

(52) U.S. Cl.

CPC ..... *C25D 17/008* (2013.01); *C25D 17/02* (2013.01); *C25D 17/06* (2013.01); *C25D 17/10* (2013.01)

(58) Field of Classification Search

None

See application file for complete search history.

(56) References Cited

U.S. PATENT DOCUMENTS

| | | | | |
|---|---|---|---|---|
| 2014/0231245 | A1* | 8/2014 | Sandmann | C25D 17/001 204/230.3 |
| 2015/0206770 | A1* | 7/2015 | Dinneen | H01L 22/12 205/82 |
| 2019/0093250 | A1* | 3/2019 | Yamasaki | C25D 5/04 |

FOREIGN PATENT DOCUMENTS

| | | | |
|---|---|---|---|
| JP | 2014-051697 | A | 3/2014 |

* cited by examiner

*Primary Examiner* — Wojciech Haske

(74) *Attorney, Agent, or Firm* — BakerHostetler

(57) ABSTRACT

A plating apparatus that allows shielding a specific portion of a substrate at a desired timing is achieved. The plating apparatus includes a plating tank 410 for housing a plating solution, an anode 430 arranged in the plating tank 410, a substrate holder 440 for holding a substrate Wf with a surface to be plated facing downward, a rotation mechanism 447 for rotating the substrate holder 440, and a shielding mechanism 460 moving a shielding member 482 between the anode 430 and the substrate Wf depending on a rotation angle of the substrate holder 440.

18 Claims, 27 Drawing Sheets

1000

PLATING APPARATUS AND PLATING METHOD

TECHNICAL FIELD

This application relates to a plating apparatus and a plating method. This application claims priority based on the international application No. PCT/JP2020/045051 filed on Dec. 3, 2020 and the Japanese patent application No. 2021-119338 filed on Jul. 20, 2021. The entire disclosure of the international application No. PCT/JP2020/045051 and the Japanese patent application No. 2021-119338, including the specifications, the claims, the drawings, and the abstracts is incorporated in this application by reference in its entirety.

BACKGROUND ART

There has been known a cup type electroplating apparatus as one example of a plating apparatus. The cup type electroplating apparatus deposits a conductive film on a surface of a substrate (for example, a semiconductor wafer) by immersing the substrate held by a substrate holder with a surface to be plated facing downward in a plating solution and applying a voltage between the substrate and an anode.

There has been known that in the cup type electroplating apparatus, an electric field formed between the anode and the substrate is shielded using a shielding member. For example, PTL 1 discloses that a current density adjacent to an outer edge portion of the substrate is reduced by arranging an anode mask ring between the anode and the substrate, thereby suppressing forming a thick plating film around the outer edge portion of the substrate.

CITATION LIST

Patent Literature

PTL 1: Japanese Unexamined Patent Application Publication No. 2014-51697

SUMMARY OF INVENTION

Technical Problem

However, in the electroplating apparatus of the related art, since the anode mask ring is fixed at an arbitrary height of an inner wall of a plating tank, a shield is constantly provided by the anode mask ring between the anode and the outer edge portion of the substrate. When a specific portion of the substrate is constantly shielded in this way, the plating film is extremely difficult to be formed on that part in some cases. Therefore, depending on the type of the substrate, there may be the need for the shield between the anode and the substrate that does not constantly shield but shields the specific portion of the substrate only at a desired timing.

Therefore, one object of this application is to achieve a plating apparatus and a plating method that allow for shielding a specific portion of a substrate at a desired timing.

Solution to Problem

According to one embodiment, a plating apparatus that includes a plating tank for housing a plating solution, an anode arranged in the plating tank, a substrate holder for holding a substrate with a surface to be plated facing downward, a rotation mechanism for rotating the substrate holder, and a shielding mechanism moving a shielding member into between the anode and the substrate depending on a rotation angle of the substrate holder. The shielding mechanism includes a cam member, a rotation drive mechanism configured to rotate the cam member, and a driven member configured to push out the shielding member to a shielding position between the anode and the substrate in association with a rotation of the cam member.

DESCRIPTION OF EMBODIMENTS

Figure 1:
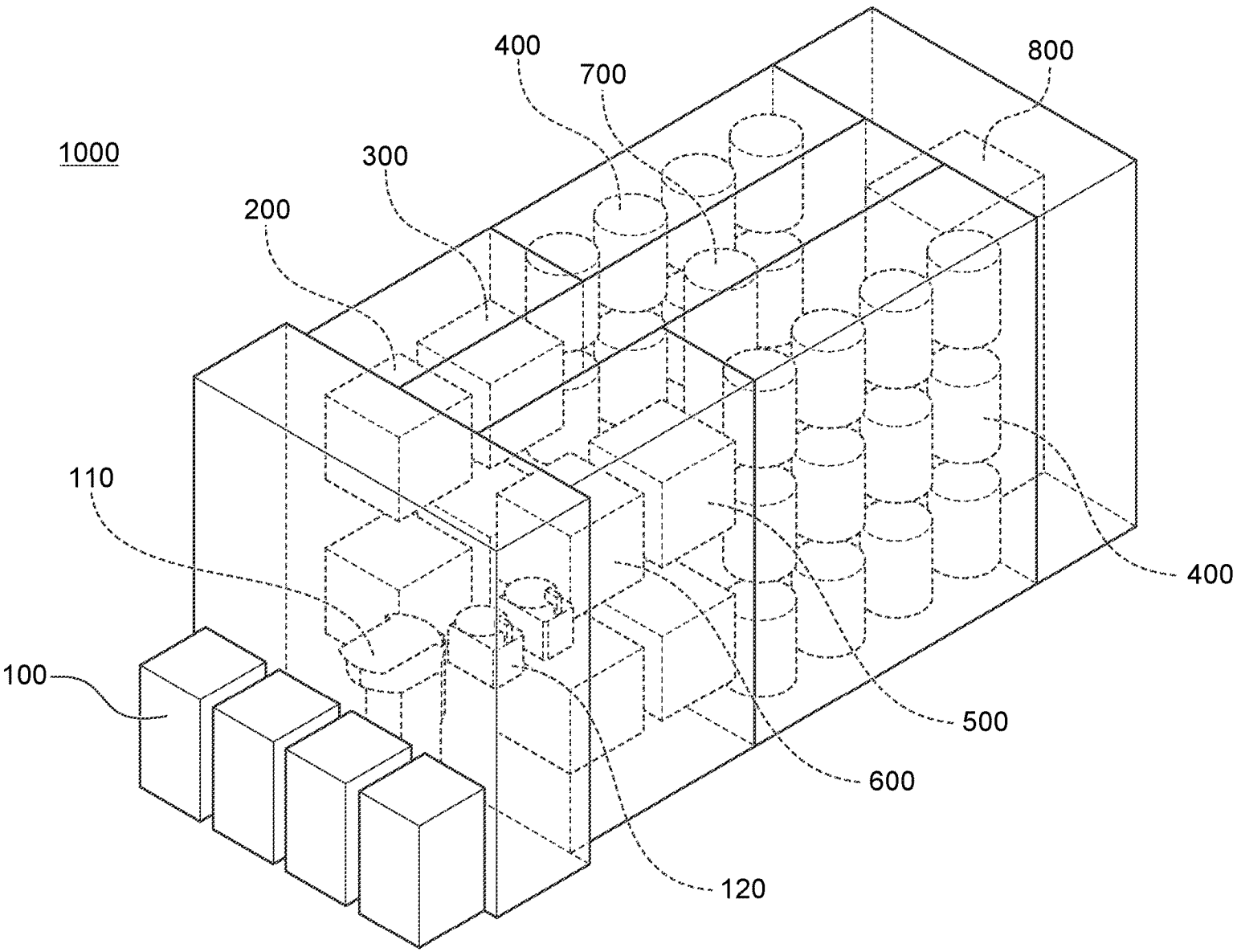
FIG. 1 is a perspective view illustrating an overall configuration of a plating apparatus of this embodiment.

The following will describe embodiments of the present invention with reference to the drawings. In the drawings described later, identical reference numerals are assigned for identical or equivalent constituent elements, and therefore such elements will not be further elaborated here.

<Overall Configuration of Plating Apparatus>

Figure 2:
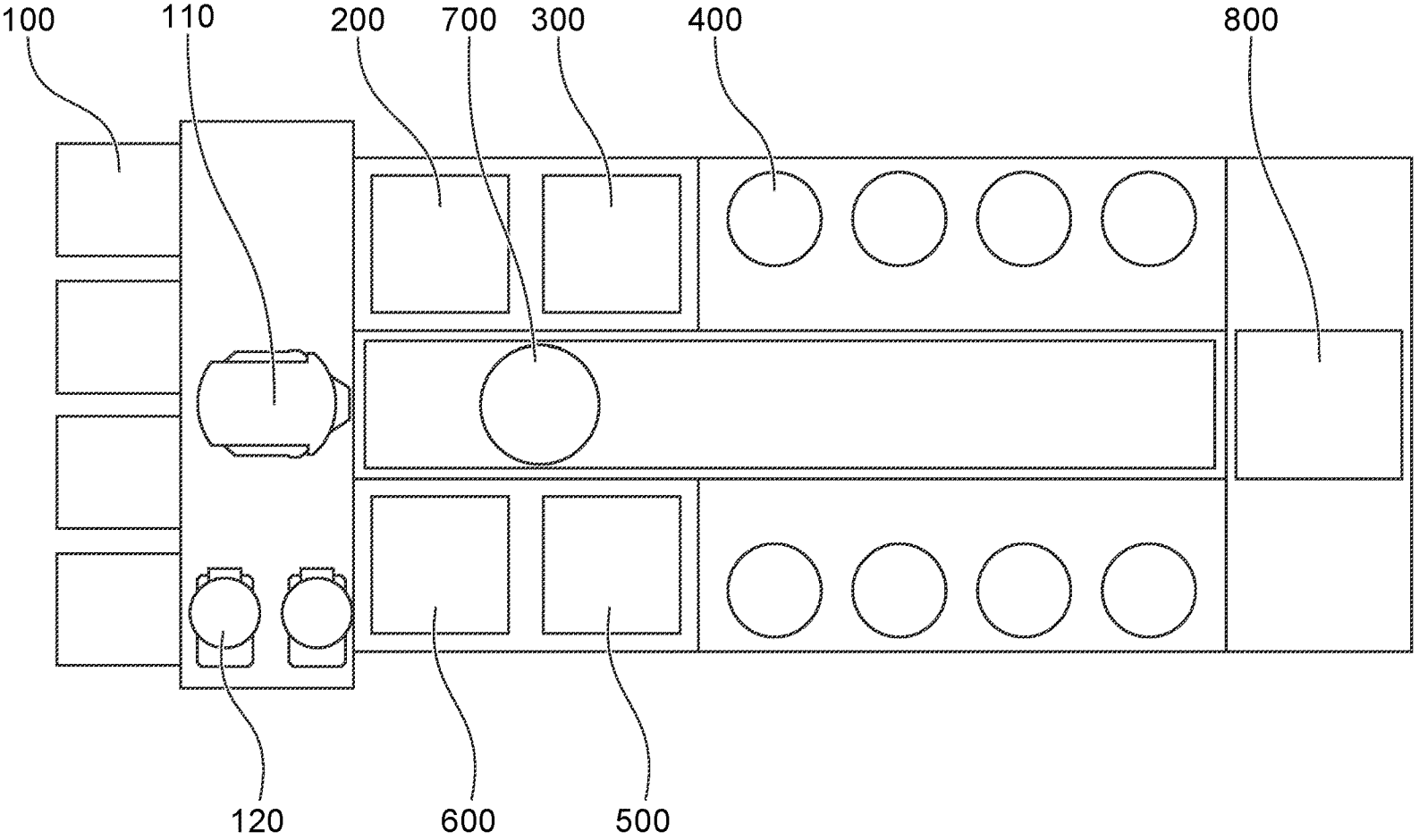
FIG. 2 is a plan view illustrating the overall configuration of the plating apparatus of this embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Figure 3:
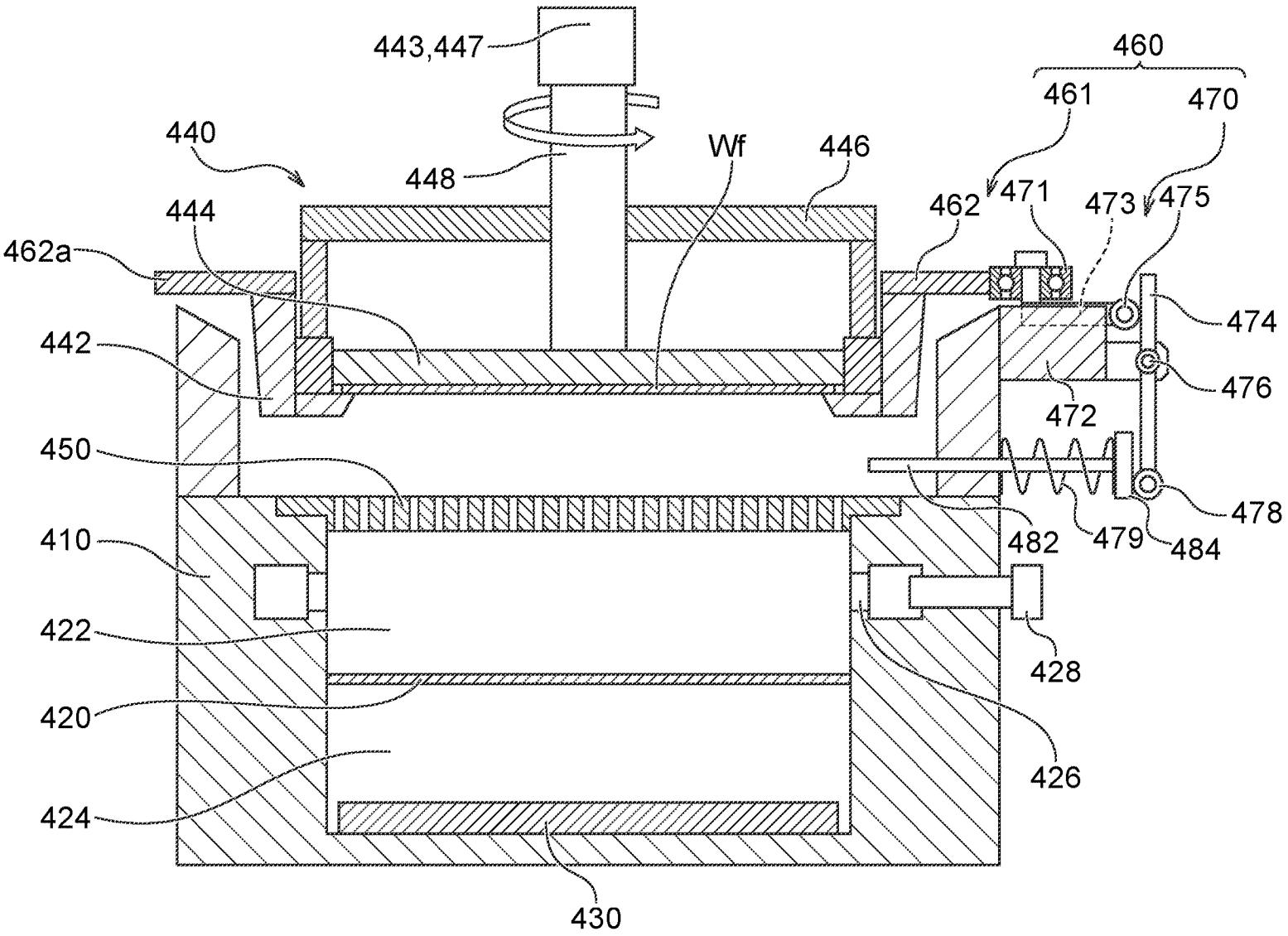
FIG. 3 is a vertical cross-sectional view schematically illustrating a configuration of a plating module of one embodiment and illustrates a state where a shielding member is retracted.

Next, a configuration of the plating modules 400 will be described. Since the 24 plating modules 400 according to this embodiment have an identical configuration, only one plating module 400 will be described. FIG. 3 is a vertical cross-sectional view schematically illustrating the configuration of the plating module of one embodiment and illustrates a state where a shielding member is retracted. As illustrated in FIG. 3, the plating module 400 includes a plating tank 410 for housing the plating solution. The plating module 400 includes a membrane 420 that separates an inside of the plating tank 410 in a vertical direction. The inside of the plating tank 410 is divided into a cathode region 422 and an anode region 424 by the membrane 420.

The cathode region 422 and the anode region 424 are each filled with the plating solution. The plating module 400 includes a nozzle 426 opening toward the cathode region 422 and a supply source 428 for supplying the plating solution to the cathode region 422 via the nozzle 426. Although, similarly for the anode region 424, the plating module 400 includes a mechanism for supplying the plating solution to the anode region 424, the mechanism is not illustrated. An anode 430 is disposed on a bottom surface of the plating tank 410 in the anode region 424. An ionically resistive element 450 opposed to the membrane 420 is arranged in the cathode region 422. The ionically resistive element 450 is a member for uniformizing the plating process on a surface to be plated Wf-a of a substrate Wf and configured by a plate-shaped member where many holes are formed.

Further, the plating module 400 includes a substrate holder 440 for holding the substrate Wf with the surface to be plated Wf-a facing downward. The substrate holder 440 includes a power feeding contact point (not illustrated) for feeding power from a power source to the substrate Wf. The substrate holder 440 includes a seal ring holder 442 for supporting an outer edge portion of the surface to be plated Wf-a of the substrate Wf and a frame 446 for holding the seal ring holder 442 to a substrate holder main body (not illustrated). Further, the substrate holder 440 includes aback plate 444 for pressing aback surface of the surface to be plated Wf-a of the substrate Wf and a shaft 448 attached to a back surface of a substrate pressing surface of the back plate 444.

The plating module 400 includes an elevating mechanism 443 for moving up and down the substrate holder 440 and a rotation mechanism 447 for rotating the substrate holder 440 so that the substrate Wf rotates about a virtual axis (virtual rotation axis extending perpendicularly in a center of the surface to be plated Wf-a) of the shaft 448. The elevating mechanism 443 and the rotation mechanism 447 can be achieved by a known mechanism, such as a motor. The plating module 400 is configured to perform the plating process on the surface to be plated Wf-a of the substrate Wf by immersing the substrate Wf in the plating solution in the cathode region 422 using the elevating mechanism 443 and applying a voltage between the anode 430 and the substrate Wf.

The plating module 400 includes a shielding member 482 for shielding an electric field formed between the anode 430 and the substrate Wf % ben the shielding member 482 is arranged between the anode 430 and the substrate Wf. The shielding member 482 may be, for example, a shielding plate formed in a plate shape. The shielding member 482 passes through a side wall of the plating tank 410 to be inserted into the cathode region 422 and has a flange 484 attached to an end portion on a side that is not inserted into the plating tank 410. In this embodiment, the shielding member 482 is configured not to be constantly arranged between the anode 430 and the substrate Wf, but to shield a specific portion of the substrate Wf at a desired timing. This point will be described below.

Figure 4:
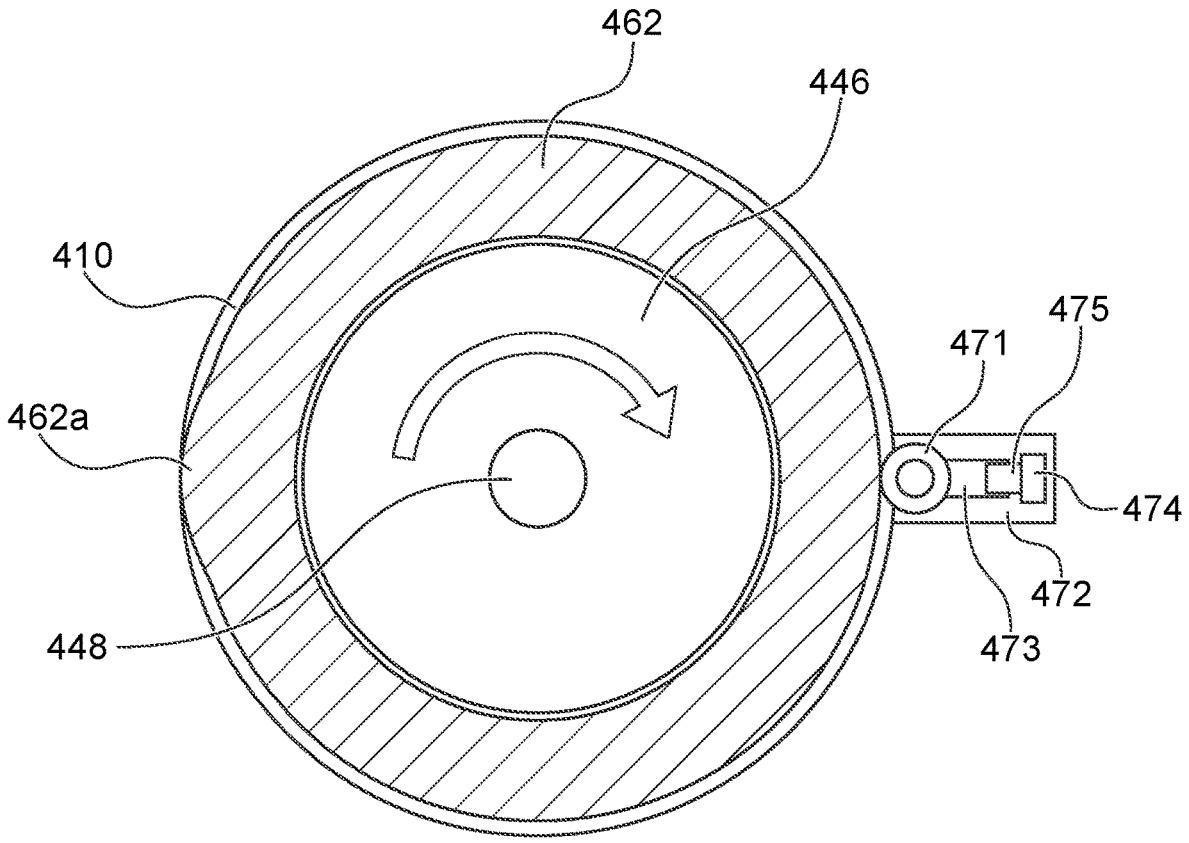
FIG. 4 is a top view schematically illustrating the configuration of the plating module of one embodiment and illustrates the state where the shielding member is retracted.

FIG. 4 is a top view schematically illustrating the configuration of the plating module of one embodiment and illustrates the state where the shielding member is retracted. As illustrated in FIG. 3 and FIG. 4, the plating module 400 includes a shielding mechanism 460 that moves the shielding member 482 between the anode 430 and the substrate Wf depending on a rotation angle of the substrate holder 440 by the rotation mechanism 447. The shielding mechanism 460 includes a cam member 461 attached to the substrate holder 440. The cam member 461 includes a disc cam 462 attached on an upper surface of the seal ring holder 442. The shielding mechanism 460 includes a driven link 470 that pushes out the shielding member 482 into between the anode 430 and the substrate Wf in response to pushing by a protrusion 462*a* of the cam member 461 (disc cam 462).

The driven link 470 includes a follower 473 that is pressed by the protrusion 462*a* of the disc cam 462 to move to a direction moving away from the substrate holder 440. A base 472 is attached on an outer wall surface at an upper portion of the plating tank 410, and the follower 473 is supported by the base 472 so as to be able to reciprocate in a radiation direction centering around the shaft 448. The follower 473 is a rod-shaped member extending in the radiation direction centering around the shaft 448. The follower 473 has one end portion to which a first roller 471 that rotates about an axis parallel to the rotation axis of the shaft 448 is attached. The follower 473 has the other end portion to which a second roller 475 that is rotatable about an axis perpendicular to both a direction of the rotation axis of the shaft 448 and the radiation direction centering around the shaft 448 is attached.

The driven link 470 includes a link 474 that rotates in response to a pushing by the follower 473 to push out the shielding member 482 into between the anode 430 and the substrate Wf. The link 474 is a rod-shaped member and rotatably supported by the base 472 about a rotation shaft 476 disposed in the base 472. The rotation shaft 476 is a rotation shaft parallel to a rotation axis of the second roller 475. The link 474 is supported by the base 472 so that one side of the link 474 across the rotation shaft 476 can come in contact with the second roller 475. To an end portion on the other side of the link 474 across the rotation shaft 476, a third roller 478 that is rotatable about an axis parallel to the rotation axis of the second roller 475 is attached. The link 474 is supported by the base 472 so that the third roller 478 can come in contact with the flange 484 of the shielding member 482.

The driven link 470 includes a pressing member 479 that pushes the shielding member 482 back to the direction moving away from between the anode 430 and the substrate Wf when the shielding member 482 is not pushed out by the link 474. While the pressing member 479 is, for example, a helical compression spring having one end portion attached to an outer wall of the plating tank 410 and the other end portion attached to the flange 484 of the shielding member 482, the pressing member 479 is not limited to this.

Next, an operation of the shielding member 482 by the shielding mechanism 460 will be described. As illustrated in FIG. 3 and FIG. 4, when the protrusion 462*a* of the disc cam 462 does not press the first roller 471, the flange 484 is pressed to the direction moving away from the plating tank 410 by a biasing force of the pressing member 479. This causes the shielding member 482 to move to a position retracted from between the anode 430 and the substrate Wf. Further, when the flange 484 is pressed to the direction moving away from the plating tank 410, the flange 484 pushes out the third roller 478, whereby the link 474 rotates counterclockwise. Then, the one side of the link 474 across the rotation shaft 476 presses the second roller 475 toward the center of the shaft 448. This causes the follower 473 to move toward the center of the shaft 448.

Figure 5:
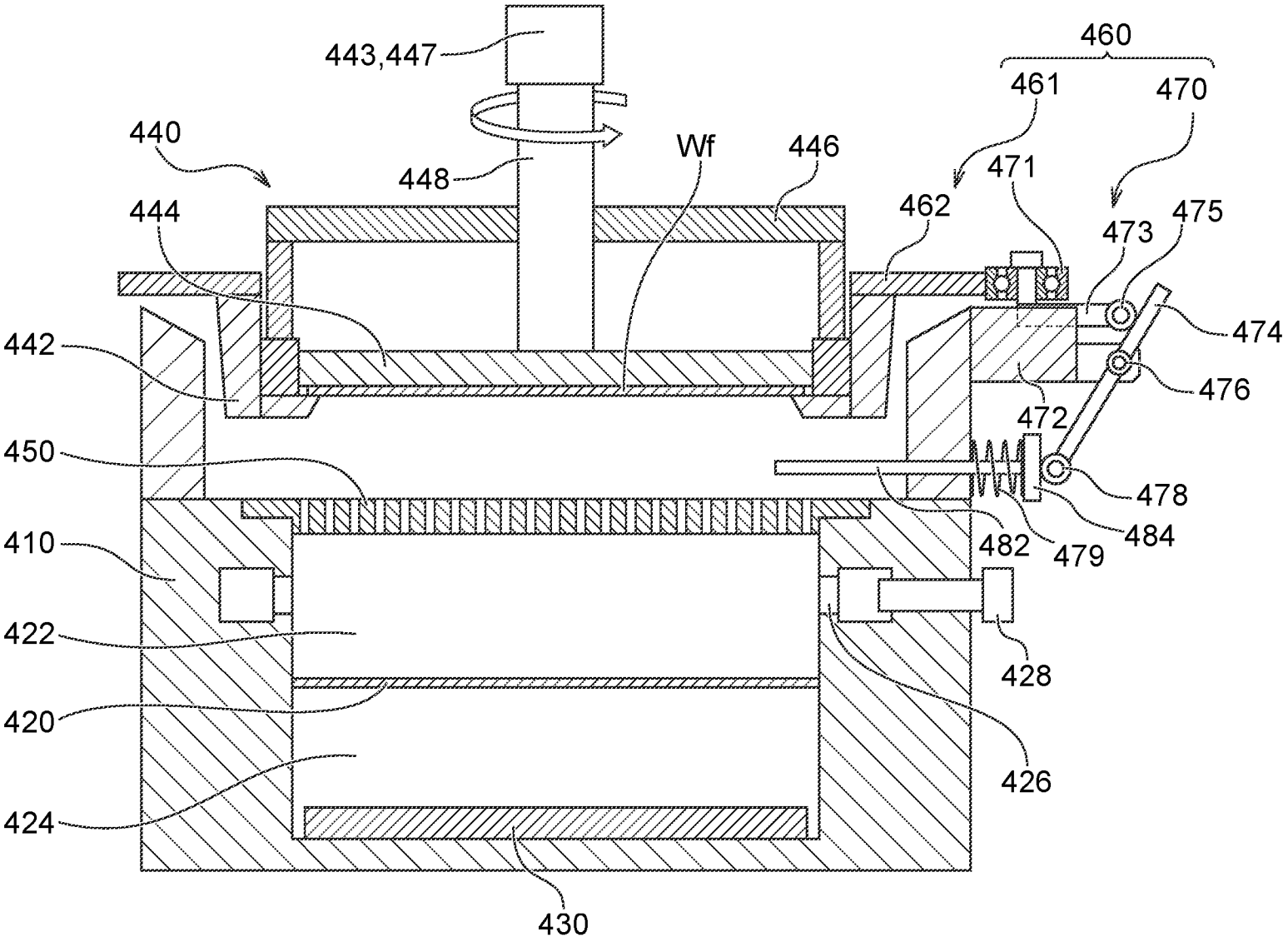
FIG. 5 is a vertical cross-sectional view schematically illustrating the configuration of the plating module of one embodiment and illustrates a state where the shielding member moves between an anode and a substrate.
Figure 6:
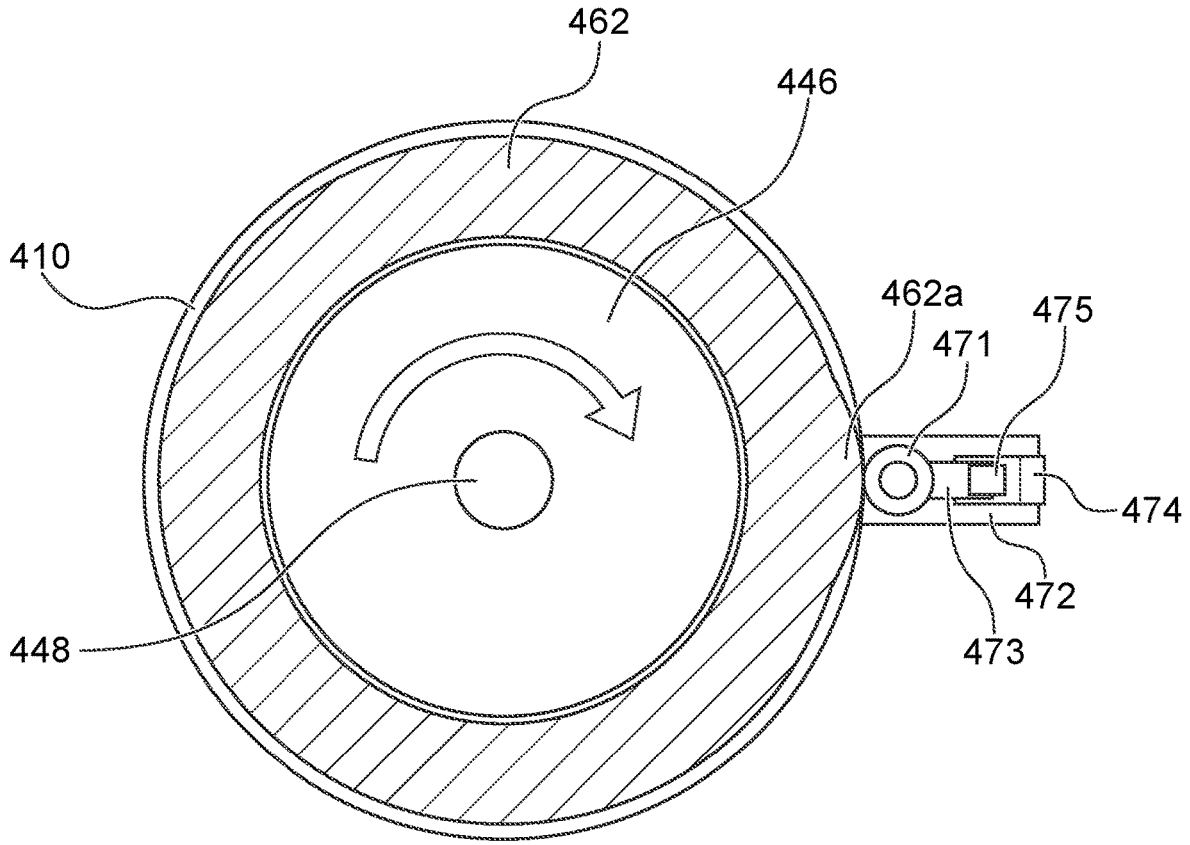
FIG. 6 is a top view schematically illustrating the configuration of the plating module of one embodiment and illustrates the state where the shielding member moves between the anode and the substrate.

FIG. 5 is a vertical cross-sectional view schematically illustrating the configuration of the plating module of one embodiment and illustrates a state where the shielding member moves between an anode and a substrate. FIG. 6 is a top view schematically illustrating the configuration of the plating module of one embodiment and illustrates the state w % here the shielding member moves between the anode and the substrate. As illustrated in FIG. 5 and FIG. 6, when the substrate holder 440 rotates and lies within the range of a predetermined rotation angle, the protrusion 462*a* of the disc cam 462 presses the first roller 471, whereby the first roller 471 moves to a direction moving away from the center of the shaft 448. In accordance with this, the follower 473 moves to the direction moving away from the center of the shaft 448 and the second roller 475 presses the one side of the link 474 across the rotation shaft 476. This causes the link 474 to rotate clockwise, and the third roller 478 presses the flange 484 to a direction approaching the plating tank 410 against the biasing force of the pressing member 479. As a result, the shielding member 482 is pushed out into between the anode 430 and the substrate Wf. When the substrate holder 440 rotates beyond the predetermined rotation angle, the shielding member 482 moves to the position retracted from between the anode 430 and the substrate Wf as described using FIG. 3 and FIG. 4.

Figure 7A:
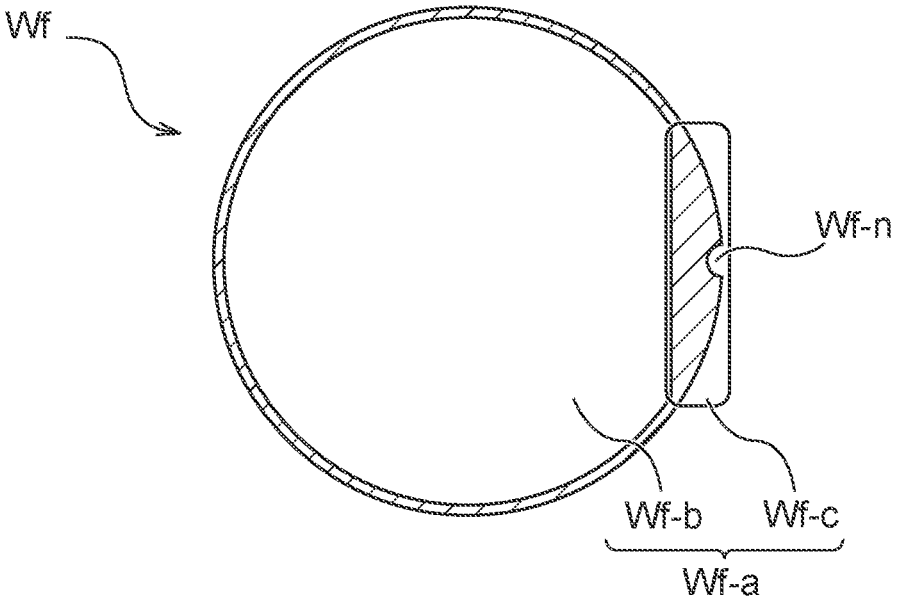
FIG. 7A is a top view illustrating a pattern area and a non-pattern area of a substrate.
Figure 7B:
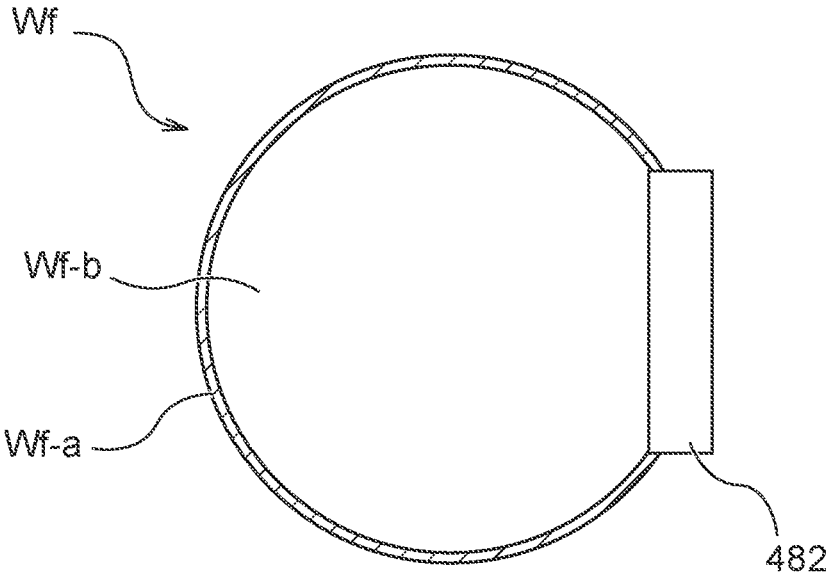
FIG. 7B is a top view illustrating an area of the substrate where a shielding member covers.

Next, a relationship between a non-pattern area of the substrate and the shielding member will be described. FIGS. 7A and 7B are top views illustrating the relationship between the non-pattern area of the substrate and the shielding member. FIG. 7A is a top view illustrating a pattern area and the non-pattern area of the substrate. FIG. 7B is a top view illustrating an area of the substrate where the shielding member covers. As illustrated in FIG. 5 and FIG. 6, FIG. 7A is a view in which the state where the substrate holder 440 lies within the range of the predetermined rotation angle is viewed from the surface to be plated Wf-a side of substrate Wf, and the shielding member 482 is not illustrated. As illustrated in FIG. 5 and FIG. 6. FIG. 7B is a view in which the state where the shielding member 482 is pushed out into between the anode 430 and the substrate Wf is viewed from the surface to be plated Wf-a side of substrate Wf.

As illustrated in FIG. 7A, the substrate Wf has a notch Wf-n (cutout). The substrate Wf is installed in the substrate holder 440 so that the notch Wf-n and the protrusion 462*a* of the disc cam 462 have an identical rotation angle. Further, the surface to be plated Wf-a of the substrate Wf has a pattern area Wf-b where a pattern, such as a circuit, is formed and a non-pattern area Wf-c around the notch Wf-n where a pattern, such as a circuit, is not formed. As illustrated in FIG. 7B, the shielding mechanism 460 is configured to push out the shielding member 482 into between the anode 430 and the notch Wf-n of the substrate Wf when the notch Wf-n of the substrate Wf rotates within a predetermined angle range. The shielding member 482 is configured to cover the notch Wf-n and the non-pattern area Wf-c around the notch Wf-n when the shielding member 482 is pushed out into between the anode 430 and the notch Wf-n of the substrate Wf by the shielding mechanism 460. Note that, in this embodiment, while the notch Wf-n or the non-pattern area Wf-c has been described as an example of the specific portion of the substrate Wf, the specific portion of the substrate Wf is not limited to these. Further, in this embodiment, while the non-pattern area Wf-c has been described as an example of a specific region around the notch Wf-n, the specific region around the notch Wf-n is not limited to this.

According to this embodiment, the shielding member 482 is not constantly arranged between the anode 430 and the substrate Wf, but the shielding mechanism 460 that moves the shielding member 482 between the anode 430 and the substrate Wf depending on the rotation angle of the substrate holder 440 is included. Accordingly, the specific portion of the substrate Wf that should be covered by the shielding member 482 can be shielded at the desired timing. For example, when the specific portion of the substrate Wf is the non-pattern area Wf-c around the notch Wf-n, the notch Wf-n and the non-pattern area Wf-c around the notch Wf-n can be shielded at a desired timing. Since in the non-pattern area Wf-c, unlike the pattern area Wf-b, the substrate Wf is exposed, an electric field is concentrated on the non-pattern area Wf-c, and as a result, a plating film thickness of the pattern area Wf-b becomes non-uniform in some cases. In contrast to this, with this embodiment, since the non-pattern area Wf-c can be covered by the shielding member 482 at the desired timing, the electric field concentration on the non-pattern area Wf-c is appropriately suppressed, and as a result, the plating film thickness of the pattern area Wf-b can be made uniform. Note that, while the example in which the notch Wf-n and a non-pattern area around the notch Wf-n are covered by the shielding member 482 has been shown in this embodiment, the configuration is not limited to this, and the specific portion of the substrate Wf can be covered at the desired timing.

Further, w % bile the example in which one protrusion 462*a* of the disc cam 462 is disposed has been shown in this embodiment, the configuration is not limited to this. For example, when a plurality of specific portions of the substrate Wf exist along a circumferential direction of the substrate Wf, a plurality of protrusions 462*a* of the disc cam 462 may be disposed depending on an arrangement of the specific portions of the substrate Wf. Further, while the example in which one shielding mechanism 460 is disposed has been shown in this embodiment, the configuration is not limited to this, and a plurality of shielding mechanisms 460 may be disposed along a circumferential direction of the plating tank 410. This allows for covering the specific portions of the substrate Wf by the shielding members 482 when the specific portions of the substrate Wf lie within the range of a plurality of different predetermined rotation angles. For example, the number of the shielding mechanisms 460 and arrangement angles may be adjusted so that the plating film thickness of the pattern area Wf-b becomes uniform.

Figure 8:
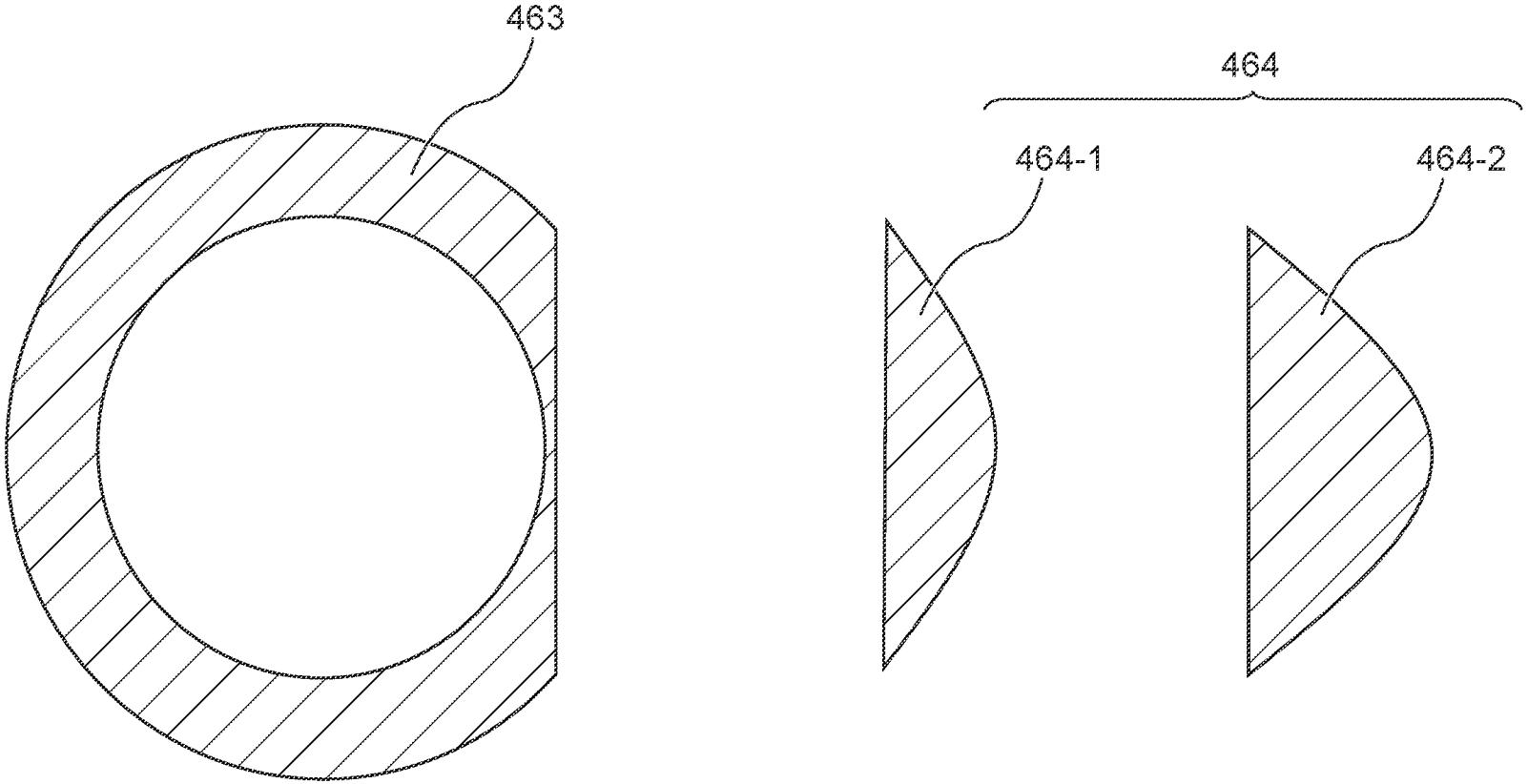
FIG. 8 is a top view illustrating a structure of a disc cam of one embodiment.

FIG. 8 is a top view illustrating a structure of a disc cam of one embodiment. While the example in which the disc cam 462 is made in an integral configuration has been shown in the above-described embodiment, the disc cam 462 is not limited to this. As illustrated in FIG. 8, the disc cam 462 may be configured to include a main body member 463 attached to the substrate holder 440 (seal ring holder 442) and a protrusion member 464 attachably/detachably attached to the main body member 463. As illustrated in FIG. 8, the protrusion member 464 includes a first protrusion member 464-1 and a second protrusion member 464-2 having a different shape from the first protrusion member 464-1. With the embodiment of FIG. 8, the protrusion member 464 can be exchanged for different types of substrates. Since the first protrusion member 464-1 and the second protrusion member 464-2 have different protrusion sizes, the amount by which the shielding member 482 is moved between the anode 430 and the substrate Wf can be differentiated. Accordingly, for example, when the size of the specific portion of the substrate Wf is different, it is only necessary to exchange only the protrusion member 464, without either exchanging the shielding mechanism 460 or exchanging the entire disc cam 462, and therefore, it is possible to rapidly deal with a plurality of types of substrates quickly.

Figure 9:
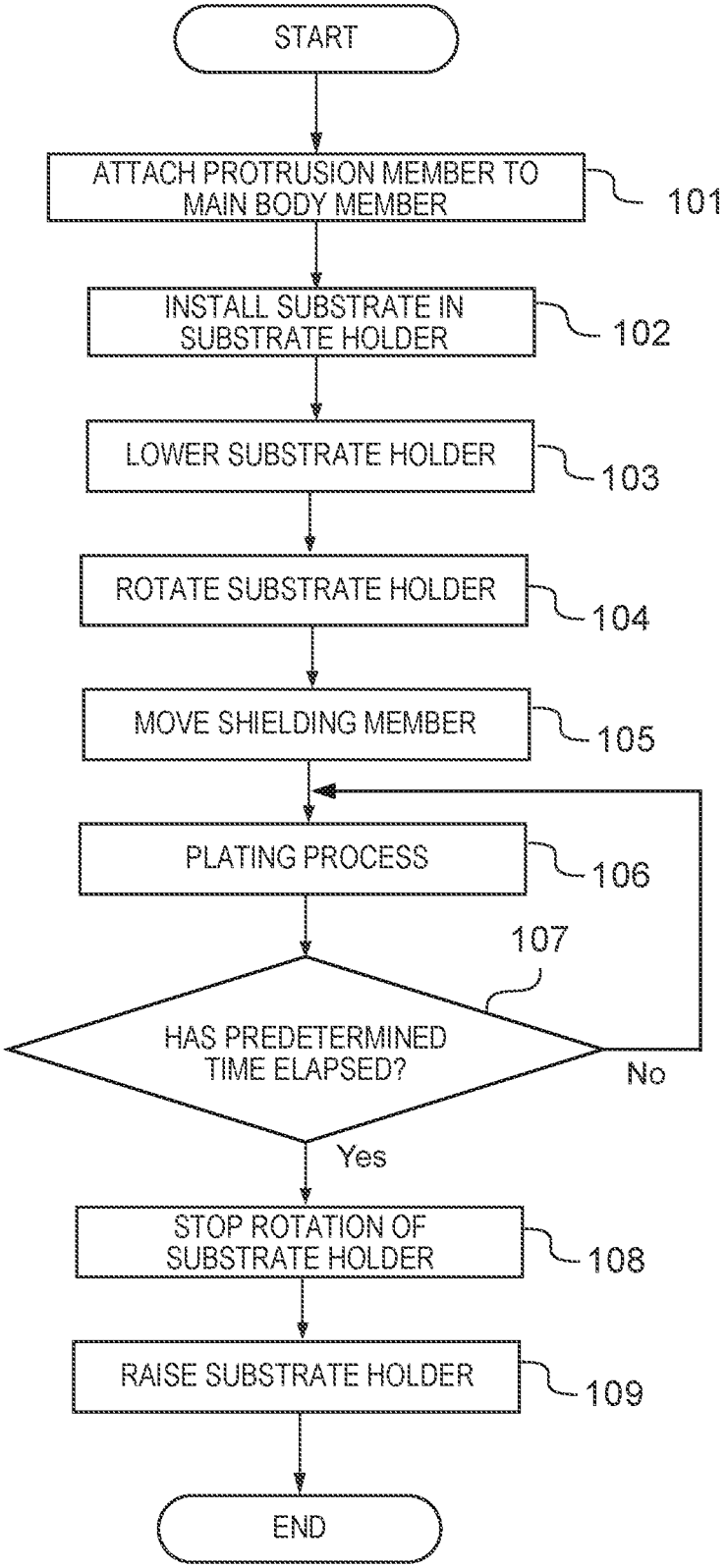
FIG. 9 is a flowchart of a plating method using a plating module of one embodiment.

Next, a plating method using the plating module 400 of this embodiment will be described. FIG. 9 is a flowchart of the plating method using a plating module of one embodiment. Note that it is assumed that the following plating method is started in a state where the protrusion member 464 is not attached to the main body member 463 of the disc cam 462.

In the plating method of this embodiment, first, a protrusion member corresponding to the type of the substrate Wf to be held by the substrate holder 440 is selected from a plurality of protrusion members (for example, the first protrusion member 464-1 and the second protrusion member 464-2) of the disc cam 462 having different protrusion sizes and attached to the main body member 463 of the disc cam 462 (step 101). Here, it is assumed that the first protrusion member 464-1 is attached to the main body member 463. Subsequently, in the plating method, the substrate Wf is installed in the substrate holder 440 (step 102). The step 102 can be performed by, for example, placing the substrate Wf with the surface to be plated Wf-a facing downward on the seal ring holder 442 with a robot hand (not illustrated) and the like and pressing the back surface of the substrate Wf by the back plate 444.

Subsequently, in the plating method, the substrate holder 440 is lowered into the plating tank 410 by the elevating mechanism 443 (lowering step 103). Subsequently, in the plating method, the substrate holder 440 is rotated by the rotation mechanism 447 (rotating step 104).

In the plating method, the shielding member 482 is moved between the anode 430 and the substrate Wf depending on the rotation angle of the substrate holder 440 by the rotating step 104 (shielding step 105). The shielding step 105 can be performed by the shielding mechanism 460. Details of the shielding step 105 will be described below. Subsequently, in the plating method, while the rotating step 104 and the shielding step 105 continue, the plating process is performed on the surface to be plated Wf-a by applying a voltage between the anode 430 arranged in the plating tank 410 and the substrate Wf held by the substrate holder 440 (plating step 106).

Subsequently, in the plating method, whether or not the plating process should end is determined (step 107). In the plating method, for example, when it is determined that the plating process should not end because a predetermined time has not elapsed since the plating process started (step 107, No), the process continues by returning to the plating step 106.

On the other hand, in the plating method, for example, when it is determined that the plating process should end because the predetermined time has elapsed since the plating process started (step 107, Yes), the rotation of the substrate holder 440 by the rotation mechanism 447 stops (step 108). Subsequently, in the plating method, the substrate holder 440 is raised by the elevating mechanism 443 (step 109) and the plating process ends.

Figure 10:
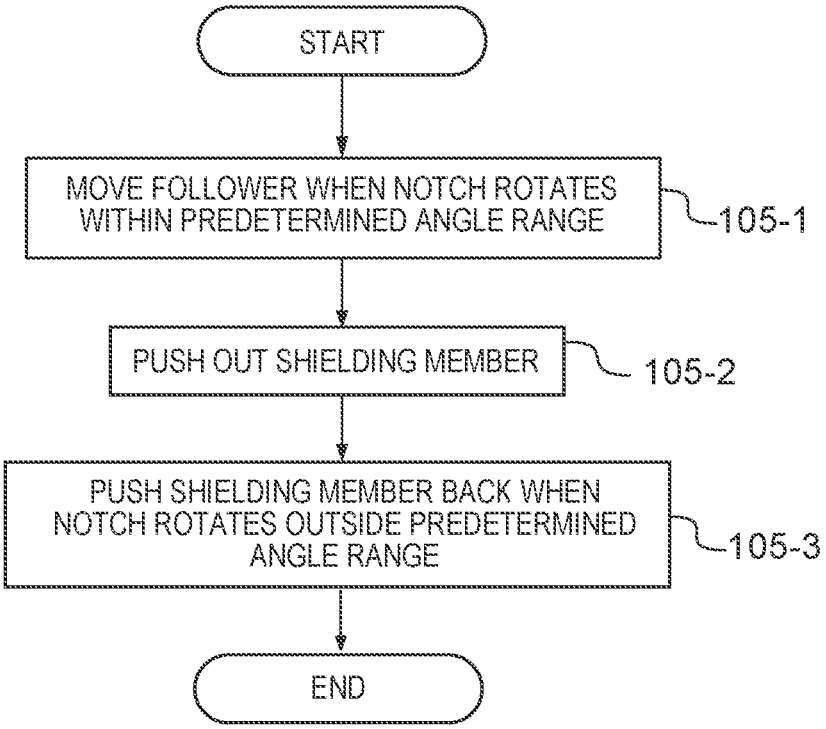
FIG. 10 is a flowchart of a shielding step in the plating method using the plating module of one embodiment.

Next, the details of the shielding step 105 will be described. FIG. 10 is a flowchart of the shielding step in the plating method using the plating module of one embodiment. In the shielding step 105, when the substrate holder 440 lies within the range of a predetermined rotation angle, specifically, when the notch Wf-n of the substrate Wf rotates within a predetermined angle range, the follower 473 is moved to the direction moving away from the substrate holder 440 by the first protrusion member 464-1 of the disc cam 462 attached to the substrate holder 440 (step 105-1).

Subsequently, in the shielding step 105, the shielding member 482 is pushed out into between the anode 430 and the substrate Wf, specifically, between the anode 430 and the notch Wf-n of the substrate Wf, by rotating the link 474 in response to the pushing by the follower 473 (step 105-2). This causes the notch Wf-n and the non-pattern area Wf-c around the notch Wf-n to be covered by the shielding member 482. Subsequently, in the shielding step 105, when the shielding member 482 is not pushed out into between the anode 430 and the substrate Wf, that is, when the substrate holder 440 rotates outside the range of the predetermined rotation angle, the shielding member 482 is pushed back to the direction moving away from between the anode 430 and the substrate Wf by the pressing member 479 (step 105-3). In the shielding step 105, while the substrate holder 440 is rotated by the rotation mechanism 447, the step 105-1 to the step 105-3 are repeated.

According to the plating method of this embodiment, the shielding member 482 is not constantly arranged between the anode 430 and the substrate Wf, but the shielding member 482 is moved between the anode 430 and the substrate Wf depending on the rotation angle of the substrate holder 440 by the shielding step 105. Accordingly, the specific portion of the substrate Wf that should be covered by the shielding member 482 can be shielded at a desired timing.

Figure 11:
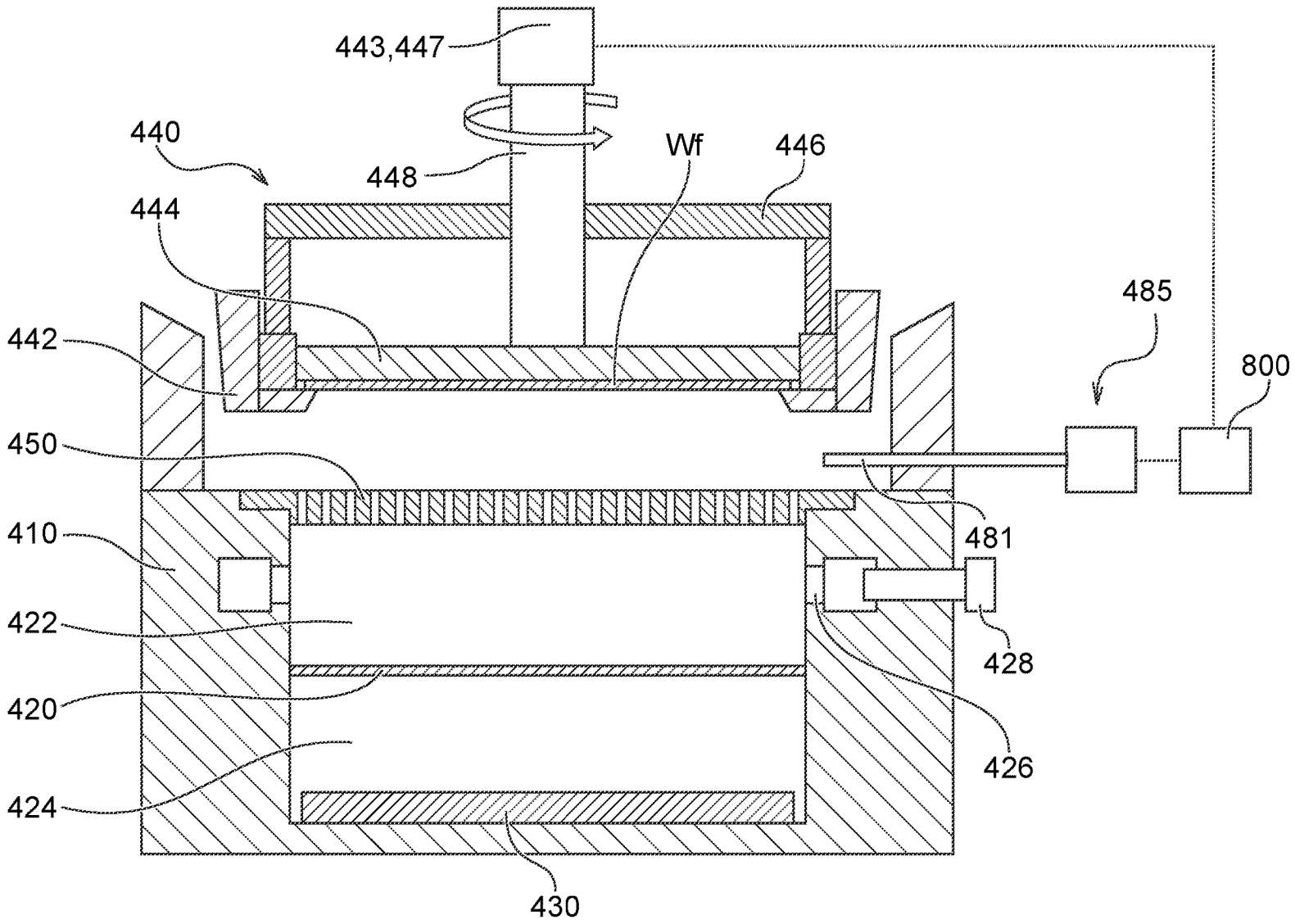
FIG. 11 is a vertical cross-sectional view schematically illustrating a configuration of a plating module of one embodiment and illustrates a state where a shielding member is retracted.
Figure 12:
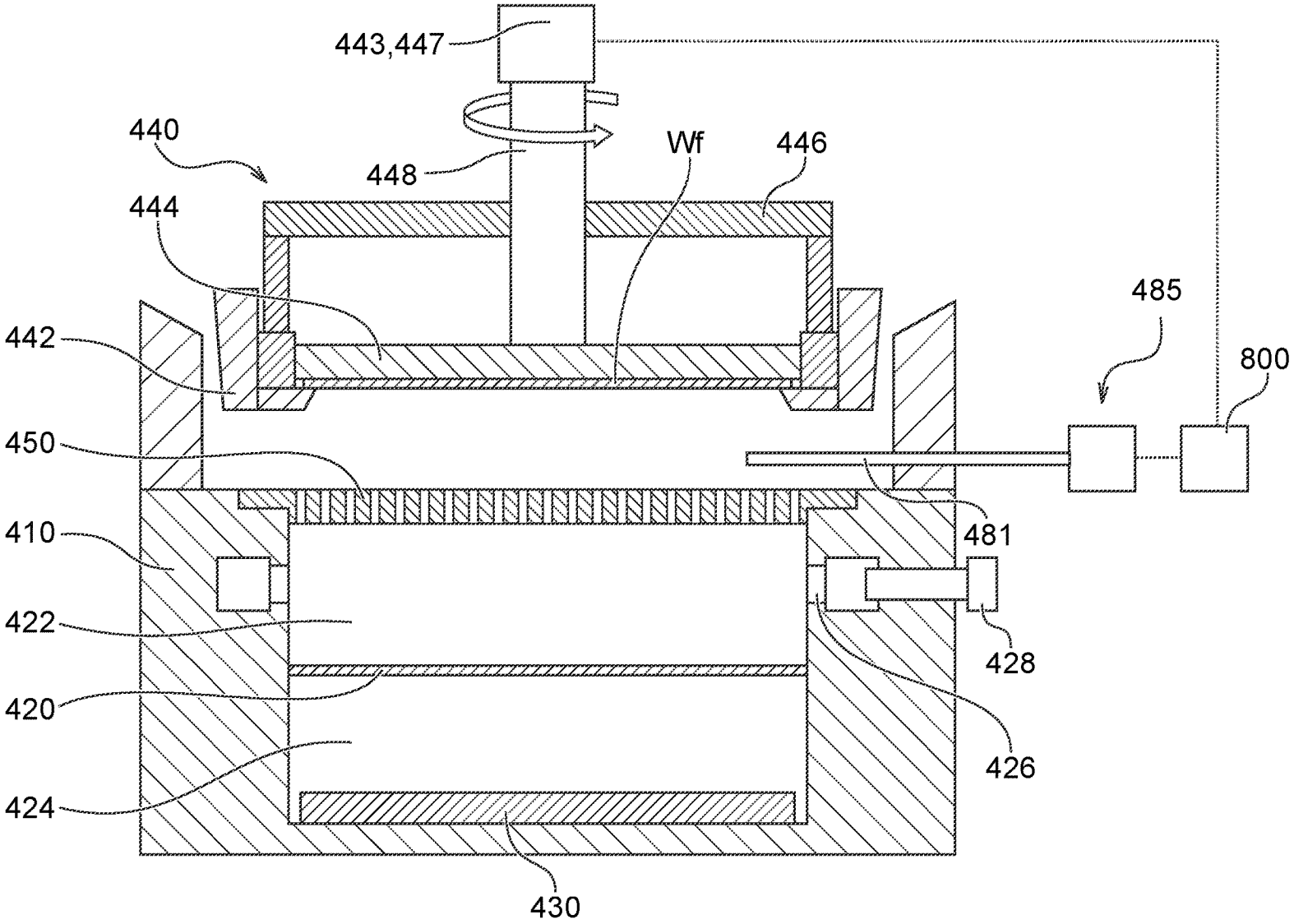
FIG. 12 is a vertical cross-sectional view schematically illustrating the configuration of the plating module of one embodiment and illustrates a state where the shielding member moves between an anode and a substrate.

Next, another embodiment of the plating module 400 will be described. FIG. 11 is a vertical cross-sectional view schematically illustrating a configuration of a plating module of one embodiment and illustrates a state where a shielding member is retracted. FIG. 12 is a vertical cross-sectional view schematically illustrating the configuration of the plating module of one embodiment and illustrates a state where the shielding member moves between an anode and a substrate. Configurations similar to those of the embodiment illustrated in FIG. 3 to FIG. 10 are denoted by identical reference signs and duplicated explanations are omitted.

As illustrated in FIG. 11 and FIG. 12, the plating module 400 includes a shielding mechanism 485 for moving a shielding member 481. The shielding mechanism 485 is configured to operate in response to a command signal based on information regarding the rotation angle of the substrate holder 440 input from the control module 800. Specifically, the shielding mechanism 485 is configured to move the shielding member 481 to a position apart from between the anode 430 and the substrate Wf (hereinafter referred to as "retracted position" as necessary) as illustrated in FIG. 11 when a specific portion, such as the non-pattern area, of the substrate Wf lies outside a predetermined angle range. Further, the shielding mechanism 485 is configured to move the shielding member 481 to a position between the anode 430 and the substrate Wf (hereinafter referred to as "shielding position" as necessary) as illustrated in FIG. 12 when the specific portion of the substrate Wf lies within the predetermined angle range. That is, the shielding mechanism 485 is configured to linearly move the shielding member 481 between the retracted position and the shielding position depending on the rotation angle of the substrate holder 440. The following describes a specific example of the shielding mechanism 485.

Figure 13:
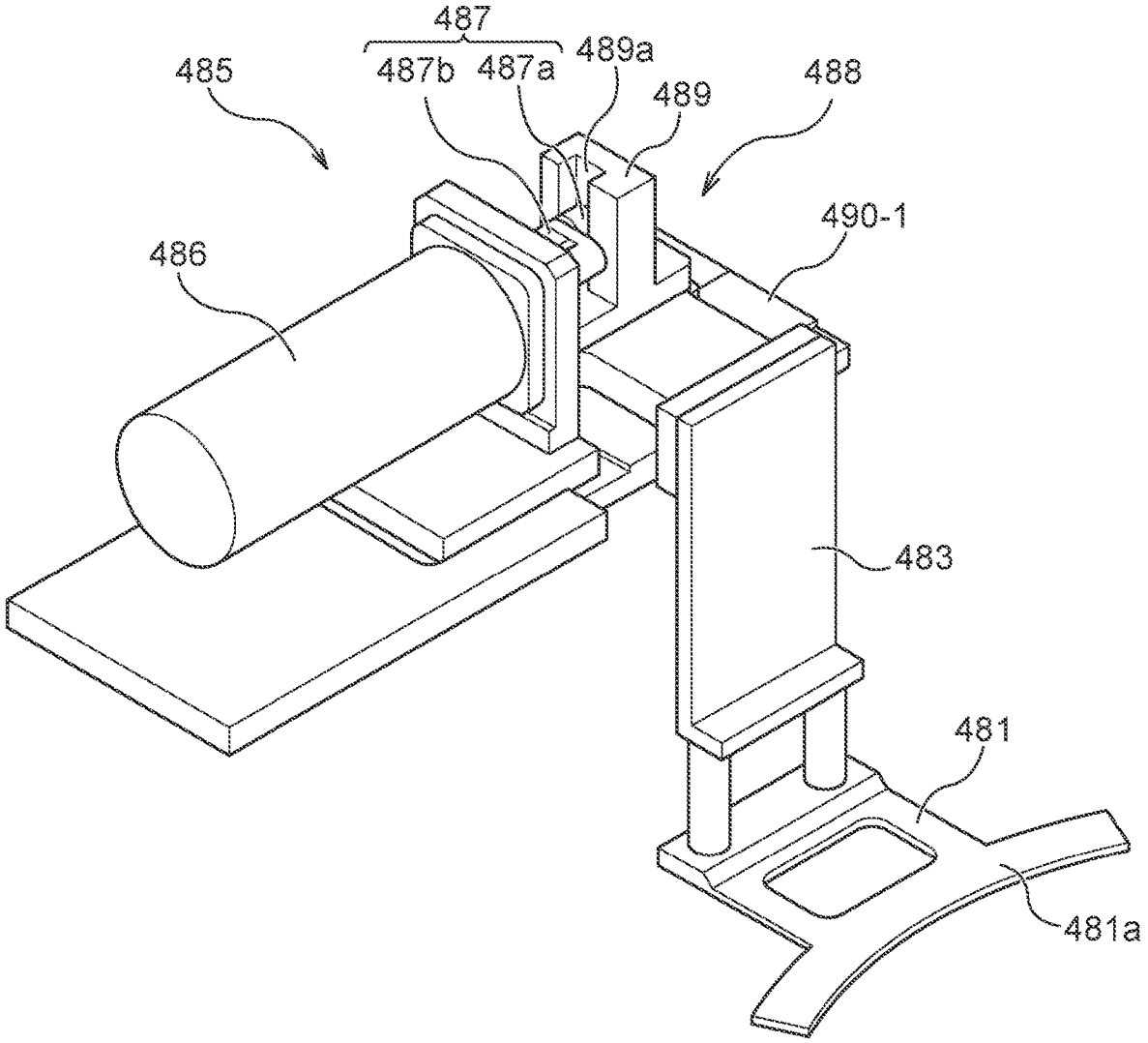
FIG. 13 is a perspective view diagrammatically illustrating a configuration of a shielding mechanism of one embodiment.
Figure 14:
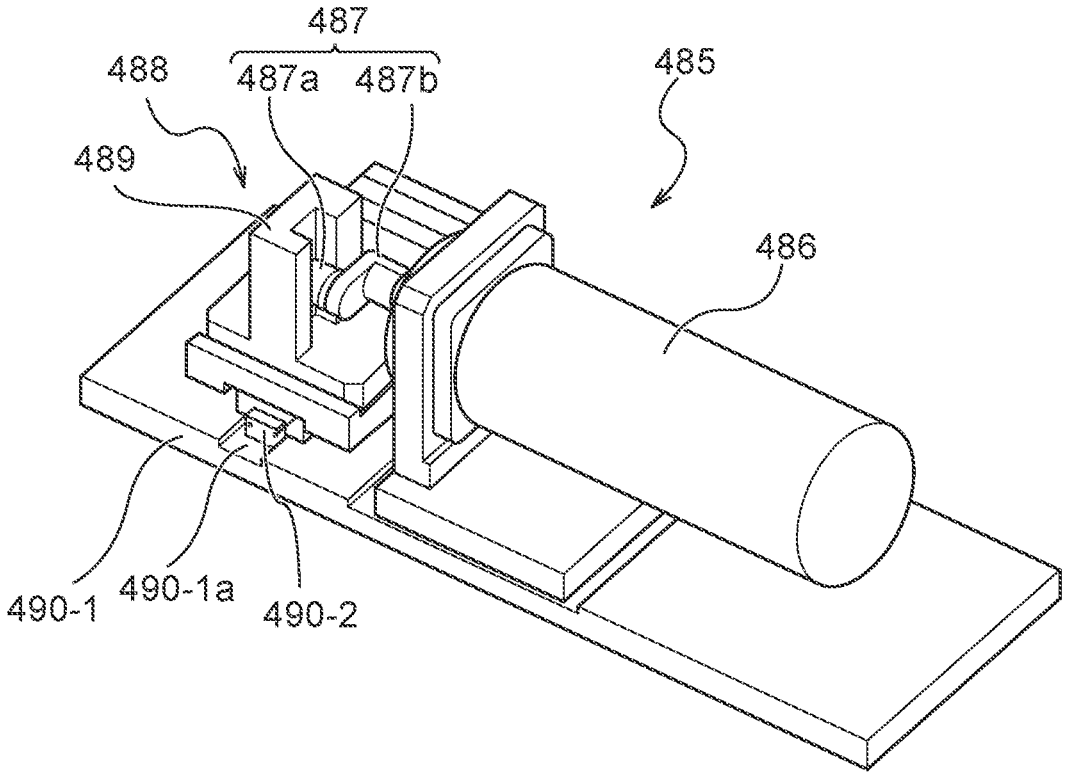
FIG. 14 is a perspective view diagrammatically illustrating the configuration of the shielding mechanism of one embodiment.
Figure 15A:
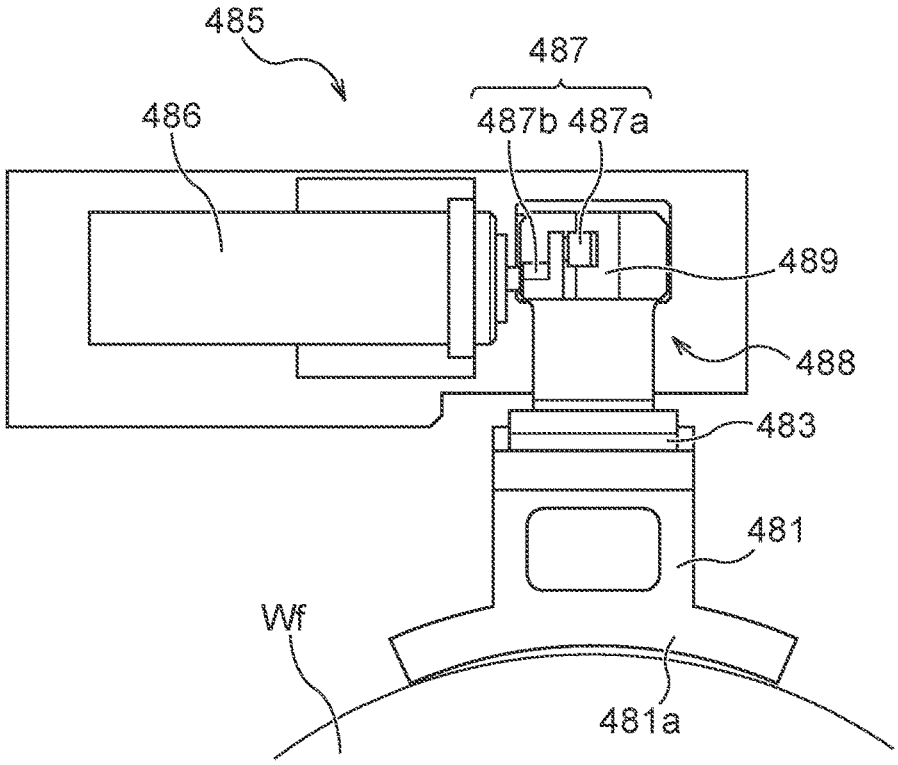
FIGS. 15A and 15B are plan views diagrammatically illustrating the configuration of the shielding mechanism of one embodiment.
Figure 15B:
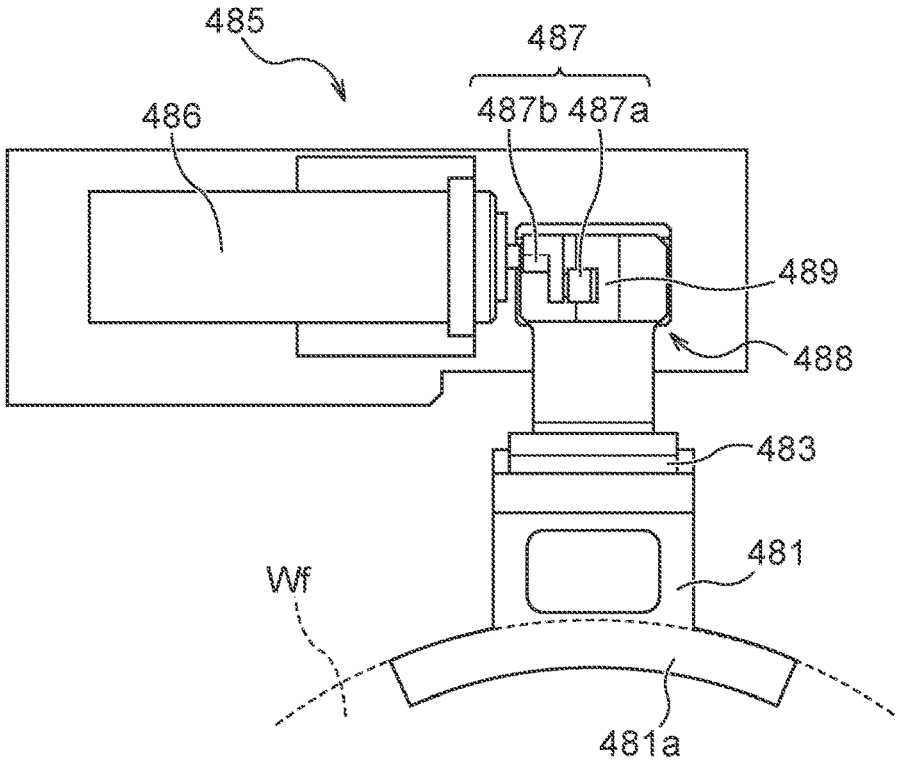

FIG. 13 is a perspective view diagrammatically illustrating a configuration of a shielding mechanism of one embodiment. FIG. 14 is a perspective view diagrammatically illustrating the configuration of the shielding mechanism of one embodiment. FIGS. 15A and 15B are plan views diagrammatically illustrating the configuration of the shielding mechanism of one embodiment. FIG. 15A illustrates a state where the shielding member 481 is in the retracted position, and FIG. 15B illustrates a state where the shielding member 481 is in the shielding position.

As illustrated in FIG. 13 to FIG. 15, the shielding mechanism 485 includes a cam member 487, a rotation drive mechanism 486 configured to rotate the cam member 487, and a driven member 488 configured to linearly move the shielding member 481 between the shielding position and the retracted position in association with a rotation of the cam member 487. The rotation drive mechanism 486 can be achieved by a known mechanism, such as a rotation motor.

The cam member 487 has a cam main body 487*b* configured to rotate by the rotation drive mechanism 486 and a rotor 487*a* attached to the cam main body 487*b*. The rotor 487*a* is attached to the cam main body 487*b* at a position eccentric with respect to a rotation axis of the rotation drive mechanism 486.

The driven member 488 includes a driven slider 489 arranged on a pedestal 490-1 and a linear motion guide 490-2 configured to guide the driven slider 489. On an upper surface of the pedestal 490-1, a groove 490-1*a* is formed along a direction identical to a linear motion direction between the shielding position and the retracted position of the shielding member 481. The driven slider 489 is arranged on the pedestal 490-1 via the linear motion guide 490-2 arranged in the groove 490-1*a*. The linear motion guide 490-2 is configured to guide the driven slider 489 along the groove 490-1*a*. This allows the driven slider 489 to reciprocate in the direction of the groove 490-1*a*. The driven slider 489 is arranged being opposed to the rotation drive mechanism 486 across the cam member 487. On an opposed surface of the driven slider 489 to the rotation drive mechanism 486, a cam groove 489*a* is formed along a vertical direction. The rotor 487*a* of the cam member 487 is fitted in the cam groove 489*a*. The shielding member 481 is attached to the driven slider 489 via a plate-shaped bracket 483 extending in the vertical direction.

When the rotation drive mechanism 486 rotates the cam member 487 (cam main body 487*b*), the rotor 487*a* rotates about the rotation axis of the rotation drive mechanism 486. At this time, the rotor 487*a* presses a side surface of the cam groove 489*a*. This causes the driven slider 489 to move along the groove 490-1*a*. When the cam member 487 is rotated through a half turn (180 degree turn) from the state (retracted position) illustrated in FIG. 13 and FIG. 14, the driven slider 489 moves the shielding member 481 to the shielding position. When the cam member 487 is further rotated through a half turn (180 degree turn) from this state, the driven slider 489 moves the shielding member 481 to the retracted position. That is, the driven slider 489 can linearly move the shielding member 481 between the shielding position and the retracted position by reciprocating along the groove 490-1*a* in association with the rotation of the cam member 487.

The rotation drive mechanism 486 is configured to rotate the cam member 487 depending on the rotation angle of the substrate holder 440. That is, similarly to the above-described embodiments, for example, the rotation drive mechanism 486 can rotate the cam member 487 so as to push out the shielding member 481 to the shielding position when the specific portion, such as the non-pattern area, of the substrate Wf rotates within the predetermined angle range. This allows for covering the specific portion, such as the non-pattern area, of the substrate Wf by the shielding member 481. Further, the rotation drive mechanism 486 can rotate the cam member 487 so as to return the shielding member 481 to the retracted position when the non-pattern area rotates outside the predetermined angle range. With this embodiment, since the non-pattern area is not constantly covered by the shielding member 481 but the non-pattern area can be covered by the shielding member 481 at a desired timing, the electric field concentration on the non-pattern area is appropriately suppressed, and as a result, the plating film thickness of the pattern area can be made uniform.

Further, as illustrated in FIGS. 15A and 15B and others, the shielding member 481 has a mask member 481*a* having an arc shape corresponding to a part of a peripheral edge portion of the circular-plate shaped substrate Wf. Since the non-pattern area is formed in an arc shape on the peripheral edge portion of the substrate Wf in some cases, only the non-pattern area can be appropriately covered by covering the non-pattern area of the substrate Wf using the arc-shaped mask member 481*a*. In this respect, the same applies to the following embodiments.

Figure 16:
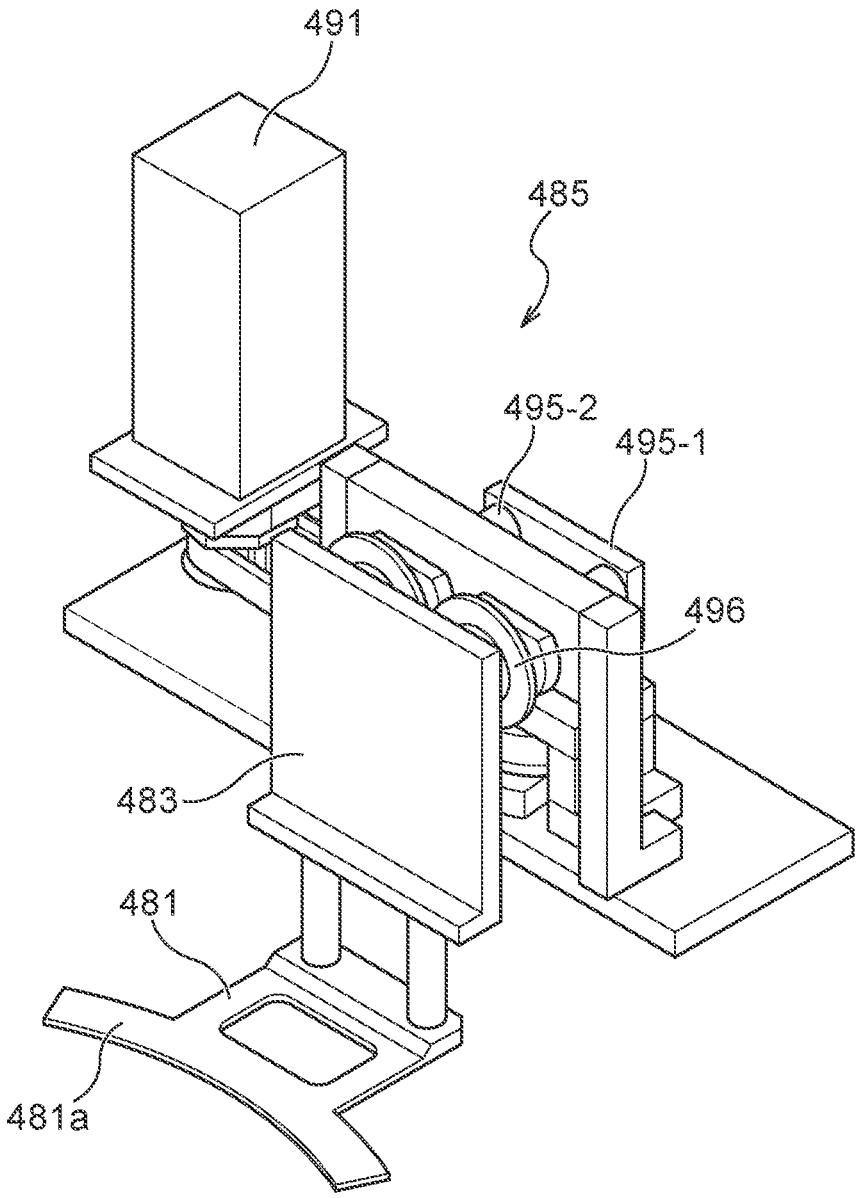
FIG. 16 is a perspective view diagrammatically illustrating a configuration of the shielding mechanism of one embodiment.
Figure 17:
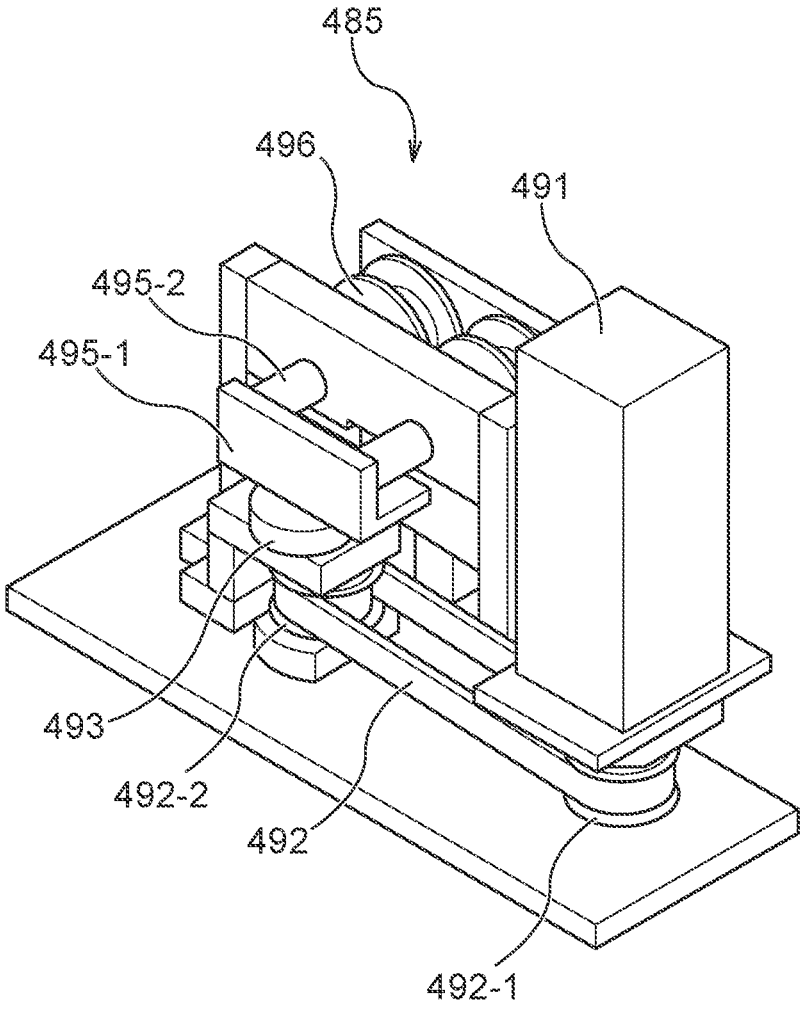
FIG. 17 is a perspective view diagrammatically illustrating the configuration of the shielding mechanism of one embodiment.
Figure 18:
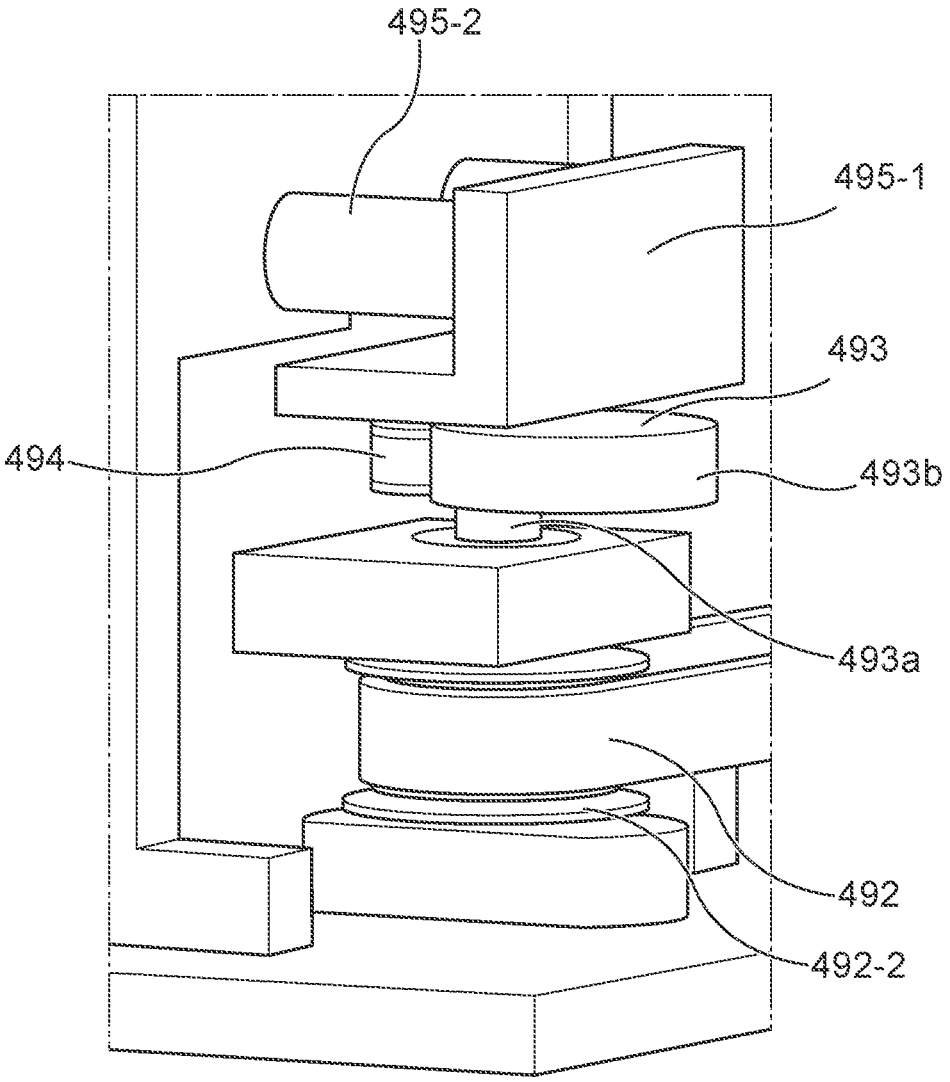
FIG. 18 is a perspective view diagrammatically illustrating a part of the configuration of the shielding mechanism of one embodiment.
Figure 19A:
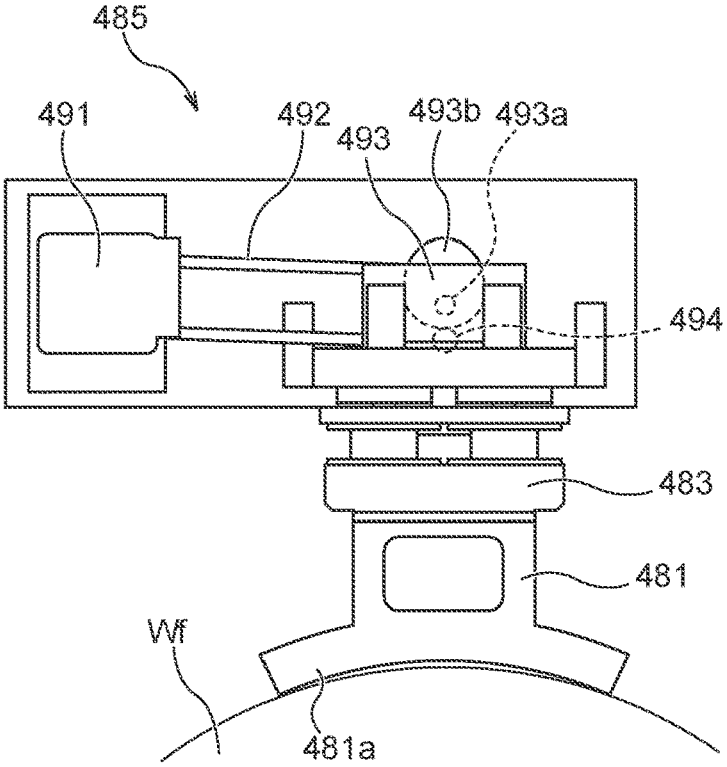
FIGS. 19A and 19B are plan views diagrammatically illustrating the configuration of the shielding mechanism of one embodiment.
Figure 19B:
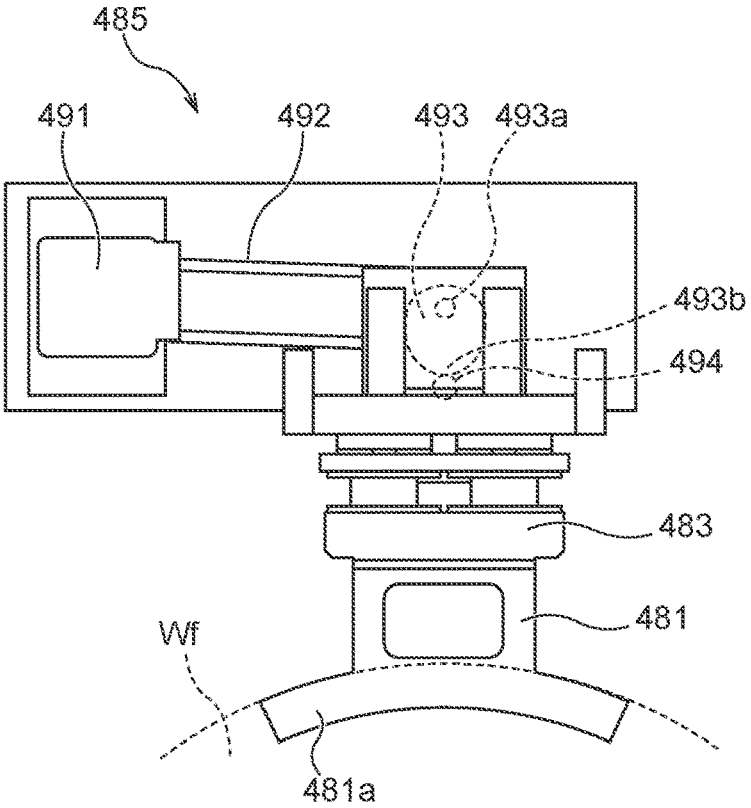

FIG. 16 is a perspective view diagrammatically illustrating a configuration of the shielding mechanism of one embodiment. FIG. 17 is a perspective view diagrammatically illustrating the configuration of the shielding mechanism of one embodiment. FIG. 18 is a perspective view diagrammatically illustrating a part of the configuration of the shielding mechanism of one embodiment. FIGS. 19A and 19B are plan views diagrammatically illustrating the configuration of the shielding mechanism of one embodiment. FIG. 19A illustrates a state where the shielding member 481 is in the retracted position, and FIG. 19B illustrates a state where the shielding member 481 is in the shielding position.

As illustrated in FIG. 16 to FIG. 19, the shielding mechanism 485 includes a belt 492 wound around a first pulley 492-1 and a second pulley 492-2 and a rotation drive mechanism 491 configured to rotate the belt 492 by rotating the first pulley 492-1. The rotation drive mechanism 491 can be achieved by a known mechanism, such as a rotation motor. Further, the shielding mechanism 485 includes an eccentric cam member 493 that is one form of a cam member coupled to the second pulley 492-2. The eccentric cam member 493 is configured to rotate about a rotation shaft 493*a* in association with a rotation of the second pulley 492-2. The shielding mechanism 485 includes a driven cam member 494 that is one form of a driven member configured to push out the shielding member 481 to the shielding position in response to pushing by a protrusion 493*b* of the eccentric cam member 493. Specifically, a bracket 495-1 is attached to the driven cam member 494, and shafts 495-2 extending in the horizontal direction are attached to the bracket 495-1. Linear motion guides 496 are attached to the shafts 495-2. The shielding member 481 is attached to the shafts 495-2 via the plate-shaped bracket 483 extending in the vertical direction.

With this, as illustrated in FIG. 19B, when the eccentric cam member 493 rotates to press the driven cam member 494 to a first direction by the protrusion 493*b* of the eccentric cam member 493, the shielding member 481 is pushed out to the shielding position via the shafts 495-2 and the bracket 483. On the other hand, the driven cam member 494 is configured to be pressed back to a second direction opposite to the first direction when the driven cam member 494 is not pressed by the protrusion 493*b* of the eccentric cam member 493. With this, as illustrated in FIG. 19A, once the eccentric cam member 493 further rotates to release the pressing of the driven cam member 494 by the protrusion 493*b* of the eccentric cam member 493, the shielding member 481 is pressed back to the retracted position.

The rotation drive mechanism 491 is configured to rotate the first pulley 492-1 depending on the rotation angle of the substrate holder 440. That is, similarly to the above-described embodiments, for example, the rotation drive mechanism 491 can rotate the first pulley 492-1 so as to push out the shielding member 481 to the shielding position when the specific portion, such as the non-pattern area, of the substrate Wf rotates within the predetermined angle range. This allows for covering the specific portion, such as the non-pattern area, of the substrate Wf by the shielding member 481. Further, the rotation drive mechanism 491 can rotate the first pulley 492-1 so as to cause the shielding member 481 to return to the retracted position when the non-pattern area rotates outside the predetermined angle range. With this embodiment, since the non-pattern area is not constantly covered by the shielding member 481 but the non-pattern area can be covered by the shielding member 481 at a desired timing, the electric field concentration on the non-pattern area is appropriately suppressed, and as a result, the plating film thickness of the pattern area can be made uniform.

Figure 20:
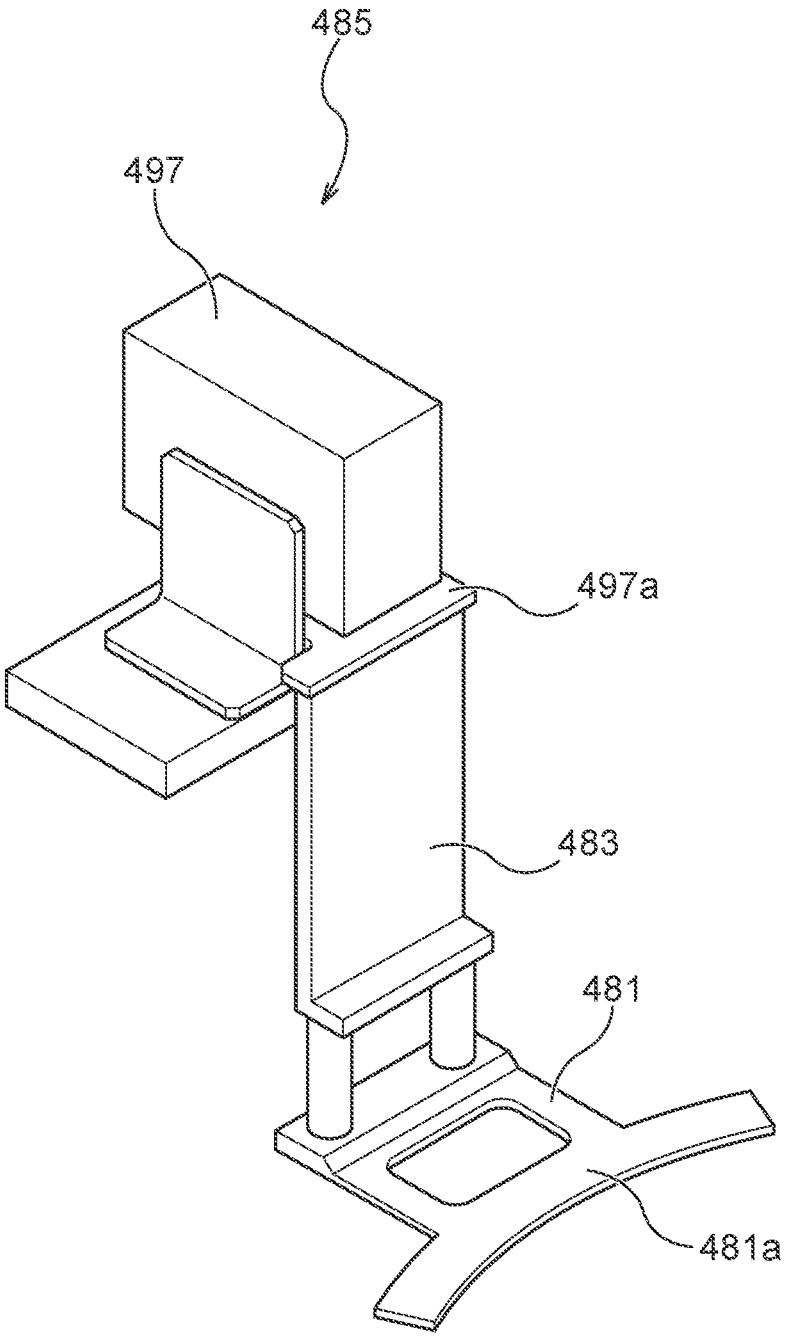
FIG. 20 is a perspective view diagrammatically illustrating a configuration of the shielding mechanism of one embodiment.
Figure 21A:
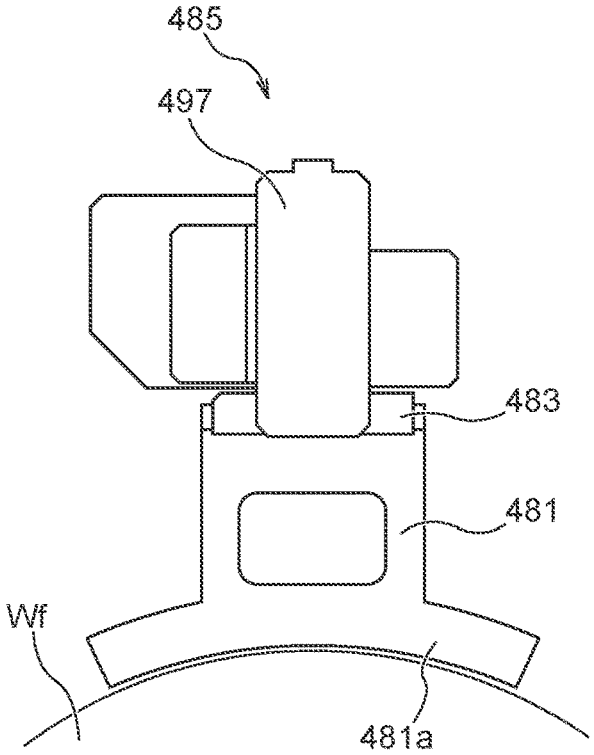
FIGS. 21A and 21B are plan views diagrammatically illustrating the configuration of the shielding mechanism of one embodiment.
Figure 21B:
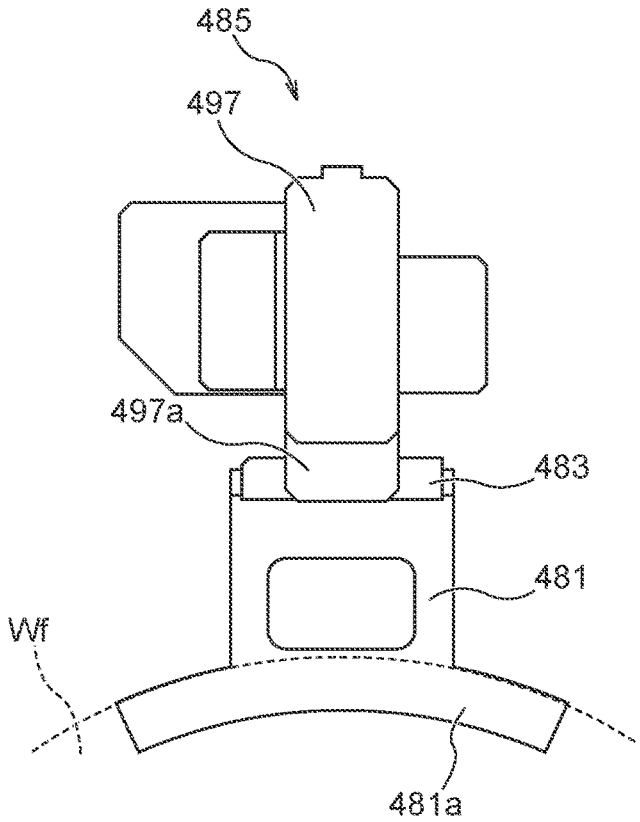

FIG. 20 is a perspective view diagrammatically illustrating a configuration of the shielding mechanism of one embodiment. FIGS. 21A and 21B are plan views diagrammatically illustrating the configuration of the shielding mechanism of one embodiment. FIG. 21A illustrates a state where the shielding member 481 is in the retracted position, and FIG. 21B illustrates a state where the shielding member 481 is in the shielding position.

As illustrated in FIG. 20 and FIG. 21, the shielding mechanism 485 includes a linear motion drive mechanism 497 configured to linearly move the shielding member 481 between the shielding position and the retracted position. Specifically, the linear motion drive mechanism 497 includes a slider 497*a* configured to reciprocate in the horizontal direction in response to driving of the linear motion drive mechanism 497. The shielding member 481 is attached to the slider 497*a* via the plate-shaped bracket 483 extending in the vertical direction. The shielding member 481 can be linearly moved between the shielding position and the retracted position by driving the linear motion drive mechanism 497. The linear motion drive mechanism 497 can be achieved by a known mechanism, such as a linear motion motor.

The linear motion drive mechanism 497 is configured to linearly move the shielding member 481 between the shielding position and the retracted position depending on the rotation angle of the substrate holder 440. That is, similarly to the above-described embodiments, for example, the linear motion drive mechanism 497 is configured to push out the shielding member 481 to the shielding position when the specific portion, such as the non-pattern area, of the substrate Wf rotates within the predetermined angle range. This allows for covering the specific portion, such as the non-pattern area, of the substrate Wf by the shielding member 481. Further, the linear motion drive mechanism 497 is configured to cause the shielding member 481 to return to the retracted position when the non-pattern area rotates outside the predetermined angle range. With this embodiment, since the non-pattern area is not constantly covered by the shielding member 481 but the non-pattern area can be covered by the shielding member 481 at a desired timing, the electric field concentration on the non-pattern area is appropriately suppressed, and as a result, the plating film thickness of the pattern area can be made uniform.

Figure 22:
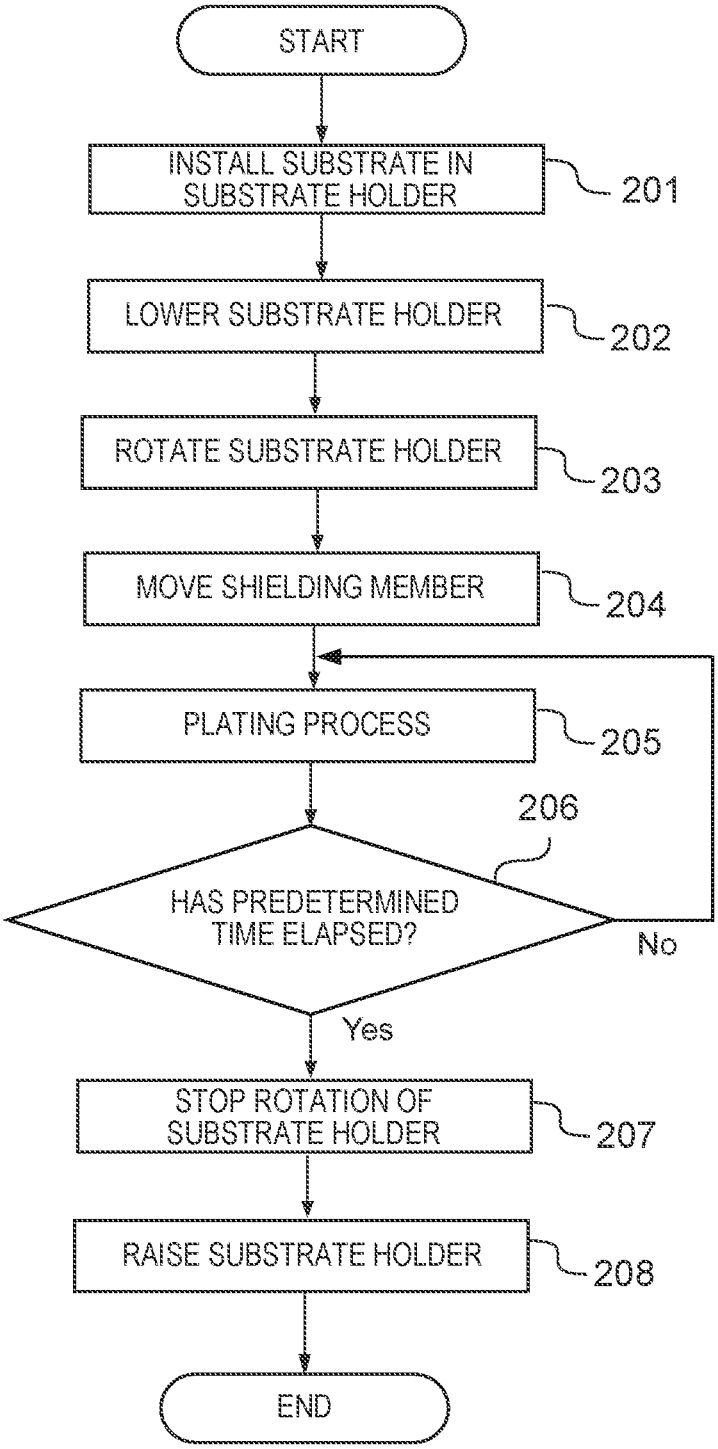
FIG. 22 is a flowchart of a plating method using a plating module of one embodiment.

Next, a plating method using the plating module 400 illustrated in FIG. 11 to FIG. 21 will be described. FIG. 22 is a flowchart of the plating method using a plating module of one embodiment.

In the plating method of this embodiment, first, the substrate Wf is installed in the substrate holder 440 (step 201). The step 201 can be performed by, for example, placing the substrate Wf with the surface to be plated Wf-a facing downward on the seal ring holder 442 with a robot hand (not illustrated) and the like and pressing the back surface of the substrate Wf by the back plate 444.

Subsequently, in the plating method, the substrate holder 440 is lowered into the plating tank 410 by the elevating mechanism 443 (lowering step 202). Subsequently, in the plating method, the substrate holder 440 is rotated by the rotation mechanism 447 (rotating step 203).

In the plating method, the shielding member 481 is moved between the anode 430 and the substrate Wf depending on the rotation angle of the substrate holder 440 by the rotating step 203 (shielding step 204). The shielding step 204 can be performed by the shielding mechanism 485. Details of the shielding step 204 will be described below. Subsequently, in the plating method, while the rotating step 203 and the shielding step 204 continue, the plating process is performed on the surface to be plated Wf-a by applying a voltage between the anode 430 arranged in the plating tank 410 and the substrate Wf held by the substrate holder 440 (plating step 205). Note that, for the plating process (plating step 205) in this embodiment, while the plating process is performed after the substrate Wf is immersed in the plating solution in the plating tank 410, the plating process (plating step 205) may be performed at the time point when at least a part of the substrate Wf is immersed in the plating solution in the plating tank 410.

Subsequently, in the plating method, whether or not the plating process should end is determined (step 206) In the plating method, for example, when it is determined that the plating process should not end because a predetermined time has not elapsed since the plating process started (step 206, No), the process continues by returning to the plating step 205.

On the other hand, in the plating method, for example, when it is determined that the plating process should end because the predetermined time has elapsed since the plating process started (step 206, Yes), the rotation of the substrate holder 440 by the rotation mechanism 447 stops (step 207).

Subsequently, in the plating method, the substrate holder 440 is raised by the elevating mechanism 443 (step 208) and the plating process ends.

Figure 23:
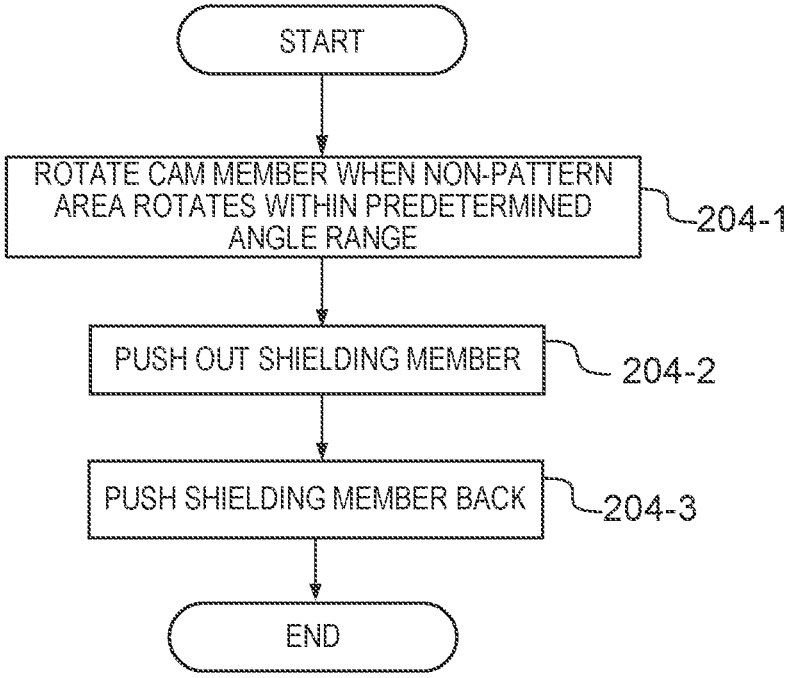
FIG. 23 is a flowchart of a shielding step in the plating method using the plating module of the embodiment of FIG. 13 to FIG. 15.

Next, the details of the shielding step 204 will be described. FIG. 23 is a flowchart of the shielding step in the plating method using the plating module of the embodiment of FIG. 13 to FIG. 15. It is assumed that, when the non-pattern area of the substrate Wf lies outside the range of a predetermined rotation angle, the rotation drive mechanism 486 stops and the shielding member 481 is in the retracted position as illustrated in FIG. 15A. In the shielding step 204, when the non-pattern area of the substrate Wf rotates within the predetermined angle range, the cam member 487 is rotated using the rotation drive mechanism 486 (step 204-1).

With this, in the shielding step 204, the rotor 487*a* presses a side surface of the cam groove 489*a* in association with the rotation of the cam member 487, whereby the driven slider 489 is moved to the first direction to push out the shielding member 481 to the shielding position as illustrated in FIG. 15B (step 204-2). This causes the non-pattern area of the substrate Wf to be covered by the shielding member 481. Subsequently, in the shielding step 204, the cam member 487 is further rotated from the state illustrated in FIG. 15B, whereby the driven slider 489 is moved to the second direction opposite to the first direction to push the shielding member 481 back to the retracted position as illustrated in FIG. 15A (step 204-3). In the shielding step 204, while the substrate holder 440 is rotated by the rotation mechanism 447, the step 204-1 to the step 204-3 are repeated. Note that, for convenience of explanation, although the step 204-2 and the step 204-3 are set as different steps, these two steps are achieved by rotating the cam member 487 one full turn (360 degree turn). Further, a rotation speed of the rotation drive mechanism 486 is adjusted so as to push the shielding member 481 back to the retracted position when the substrate holder 440 rotates outside the range of the predetermined rotation angle.

According to the plating method of this embodiment, the shielding member 481 is not constantly arranged in the shielding position, but the shielding member 481 is moved to the shielding position depending on the rotation angle of the substrate holder 440 by the shielding step 204. Accordingly, the specific portion of the substrate Wf that should be covered by the shielding member 481 can be shielded at a desired timing.

Figure 24:
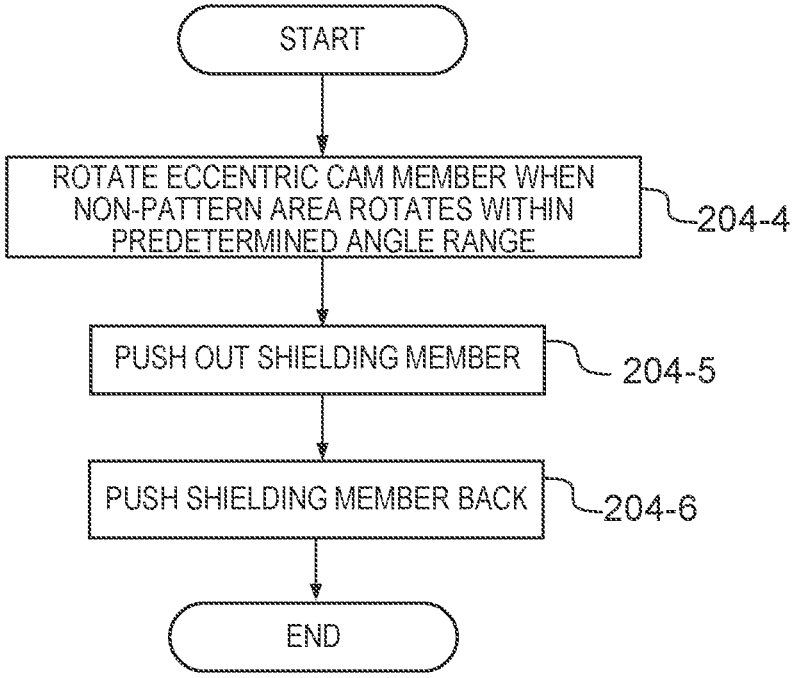
FIG. 24 is a flowchart of a shielding step in the plating method using the plating module of the embodiment of FIG. 16 to FIG. 19.

FIG. 24 is a flowchart of the shielding step in the plating method using the plating module of the embodiment of FIG. 16 to FIG. 19. It is assumed that, when the non-pattern area of the substrate Wf lies outside the range of a predetermined rotation angle, the rotation drive mechanism 491 stops and the shielding member 481 is in the retracted position as illustrated in FIG. 19A. In the shielding step 204, when the non-pattern area of the substrate Wf rotates within the predetermined angle range, the eccentric cam member 493 is rotated by rotating the first pulley 492-1 using the rotation drive mechanism 491 (step 204-4).

With this, in the shielding step 204, the protrusion 493*b* of the eccentric cam member 493 pushes and moves the driven cam member 494 to the first direction, whereby the shielding member 481 is pushed out to the shielding position as illustrated in FIG. 19B (step 204-5). This causes the non-pattern area of the substrate Wf to be covered by the shielding member 481. Subsequently, in the shielding step 204, the eccentric cam member 493 is further rotated from the state illustrated in FIG. 19B, whereby the pressing of the driven cam member 494 by the protrusion 493*b* is released and the driven slider 489 is moved to the second direction opposite to the first direction to push the shielding member 481 back to the retracted position illustrated in FIG. 19A (step 204-6). In the shielding step 204, while the substrate holder 440 is rotated by the rotation mechanism 447, the step 204-4 to the step 204-6 are repeated. Note that, for convenience of explanation, although the step 204-5 and the step 204-6 are set as different steps, these two steps are achieved by one full turn (360 degree turn) of the eccentric cam member 493. Further, a rotation speed of the rotation drive mechanism 491 is adjusted so as to push the shielding member 481 back to the retracted position when the substrate holder 440 rotates outside the range of the predetermined rotation angle.

According to the plating method of this embodiment, the shielding member 481 is not constantly arranged in the shielding position, but the shielding member 481 is moved to the shielding position depending on the rotation angle of the substrate holder 440 by the shielding step 204. Accordingly, the specific portion of the substrate Wf that should be covered by the shielding member 481 can be shielded at a desired timing.

Figure 25:
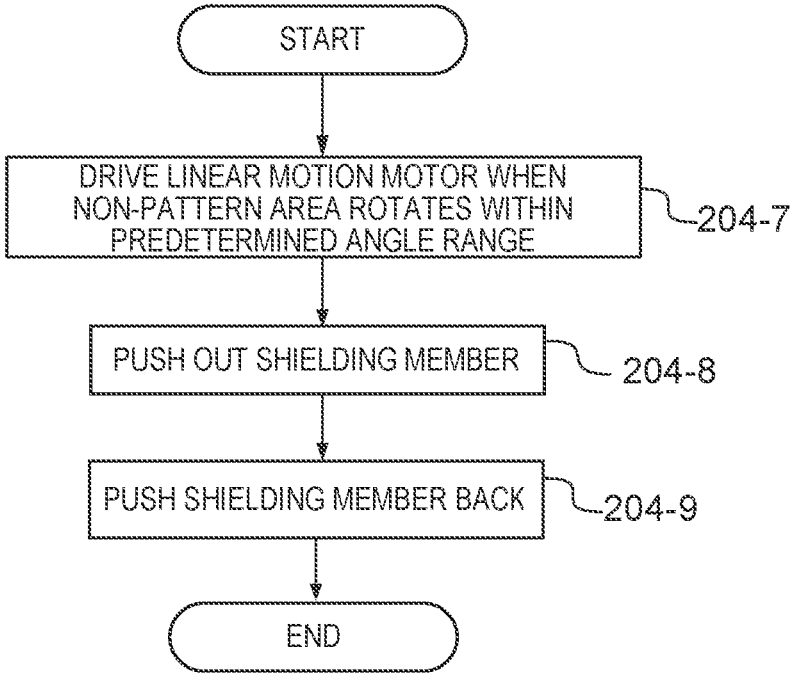
FIG. 25 is a flowchart of a shielding step in the plating method using the plating module of the embodiment of FIG. 20 and FIG. 21.

FIG. 25 is a flowchart of the shielding step in the plating method using the plating module of the embodiment of FIG. 20 and FIG. 21. It is assumed that, when the non-pattern area of the substrate Wf lies outside the range of a predetermined rotation angle, the linear motion drive mechanism 497 stops and the shielding member 481 is in the retracted position as illustrated in FIG. 21A. In the shielding step 204, when the non-pattern area of the substrate Wf rotates within the predetermined angle range, the linear motion drive mechanism 497 is driven (step 204-7).

With this, in the shielding step 204, the slider 497*a* is moved to the first direction, whereby the shielding member 481 is pushed out to the shielding position as illustrated in FIG. 21B (step 204-8). This causes the non-pattern area of the substrate Wf to be covered by the shielding member 481. Subsequently, in the shielding step 204, the linear motion drive mechanism 497 is further driven to move the slider 497*a* to the second direction opposite to the first direction, whereby the shielding member 481 is pressed back to the retracted position illustrated in FIG. 21A (step 204-9). In the shielding step 204, while the substrate holder 440 is rotated by the rotation mechanism 447, the step 204-7 to the step 204-9 are repeated. Further, a driving speed of the linear motion drive mechanism 497 is adjusted so as to push the shielding member 481 back to the retracted position when the substrate holder 440 rotates outside the range of the predetermined rotation angle.

According to the plating method of this embodiment, the shielding member 481 is not constantly arranged in the shielding position, but the shielding member 481 is moved to the shielding position depending on the rotation angle of the substrate holder 440 by the shielding step 204. Accordingly, the specific portion of the substrate Wf that should be covered by the shielding member 481 can be shielded at a desired timing.

Figure 26:
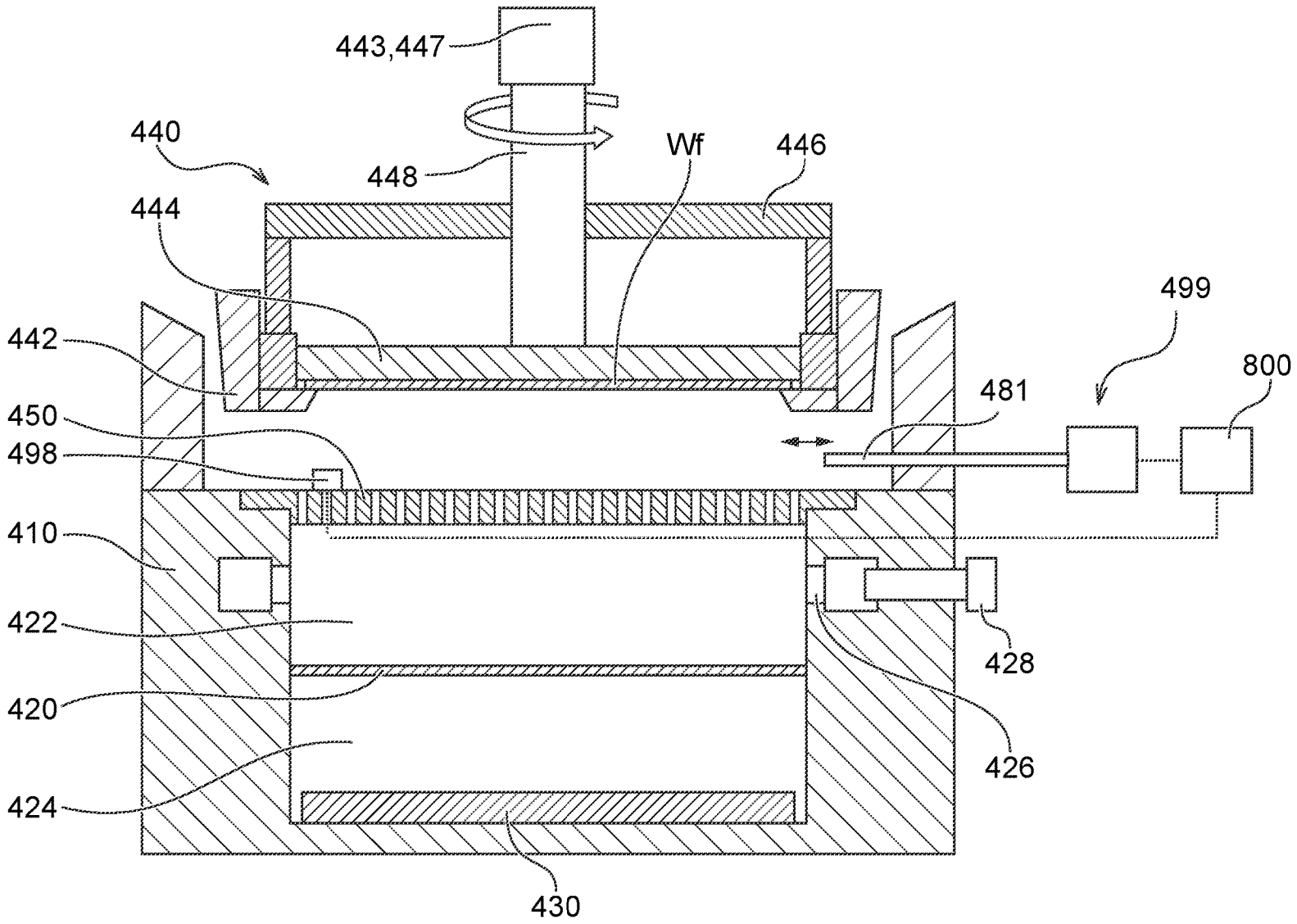
FIG. 26 is a vertical cross-sectional view schematically illustrating a configuration of a plating module of one embodiment.

Next, another embodiment of the plating module 400 will be described. FIG. 26 is a vertical cross-sectional view schematically illustrating a configuration of a plating module of one embodiment. Configurations similar to those of the embodiments illustrated in FIG. 3 to FIG. 25 are denoted by identical reference signs and duplicated explanations are omitted.

As illustrated in FIG. 26, the plating module 400 includes a film thickness sensor 498 configured to measure a plating film thickness of the substrate Wf and a shielding mechanism 499 configured to move the shielding member 481 to the shielding position based on the plating film thickness of the substrate Wf measured by the film thickness sensor 498. The shielding mechanism 499 is configured to operate in response to a command signal based on information regarding the plating film thickness of the substrate Wf input from the control module 800. The shielding mechanism 499 can have a structure similar to that of any of the shielding mechanisms 485 illustrated in FIG. 13 to FIG. 21.

The film thickness sensor 498 is configured to measure the plating film thickness at a peripheral edge portion on the surface to be plated of the substrate Wf. The film thickness sensor 498 is attached to the ionically resistive element 450 so as to be arranged being opposed to the peripheral edge portion of the substrate Wf. The film thickness sensor 498 can measure the plating film thickness by scanning the peripheral edge portion while the substrate Wf rotates one full turn. However, the film thickness sensor 498 may be configured to measure the plating film thickness on the whole surface to be plated of the substrate Wf. As the film thickness sensor 498, as one example, a distance sensor that measures a distance between the film thickness sensor 498 and the substrate Wf (plating film) or a displacement sensor that measures a displacement of the surface to be plated of the substrate Wf can be employed. Further, as the film thickness sensor 498, a sensor for estimating a forming speed of the plating film thickness may be employed. As the film thickness sensor 498, for example, an optical sensor of confocal type and the like, an electric potential sensor, a magnetic field sensor, or an eddy current sensor can be used.

The shielding mechanism 499 is configured to linearly move the shielding member 481 between the retracted position and the shielding position so that the plating film thickness at the peripheral edge portion of the substrate Wf becomes uniform. Specifically, in a case where an area having a thicker plating film thickness than other areas exists in distribution of the plating film thickness at the peripheral edge portion of the substrate Wf, the shielding mechanism 499 is configured to move the shielding member 481 to the retracted position when the area having a thicker plating film thickness lies outside the predetermined angle range. Further, the shielding mechanism 499 is configured to move the shielding member 481 to the shielding position when the area having a thicker plating film thickness lies within the predetermined angle range. Accordingly, with this embodiment, since the area having a thicker plating film thickness of the substrate Wf can be covered by the shielding member 481, the plating film thickness at the peripheral edge portion of the substrate Wf can be made uniform.

Figure 27:
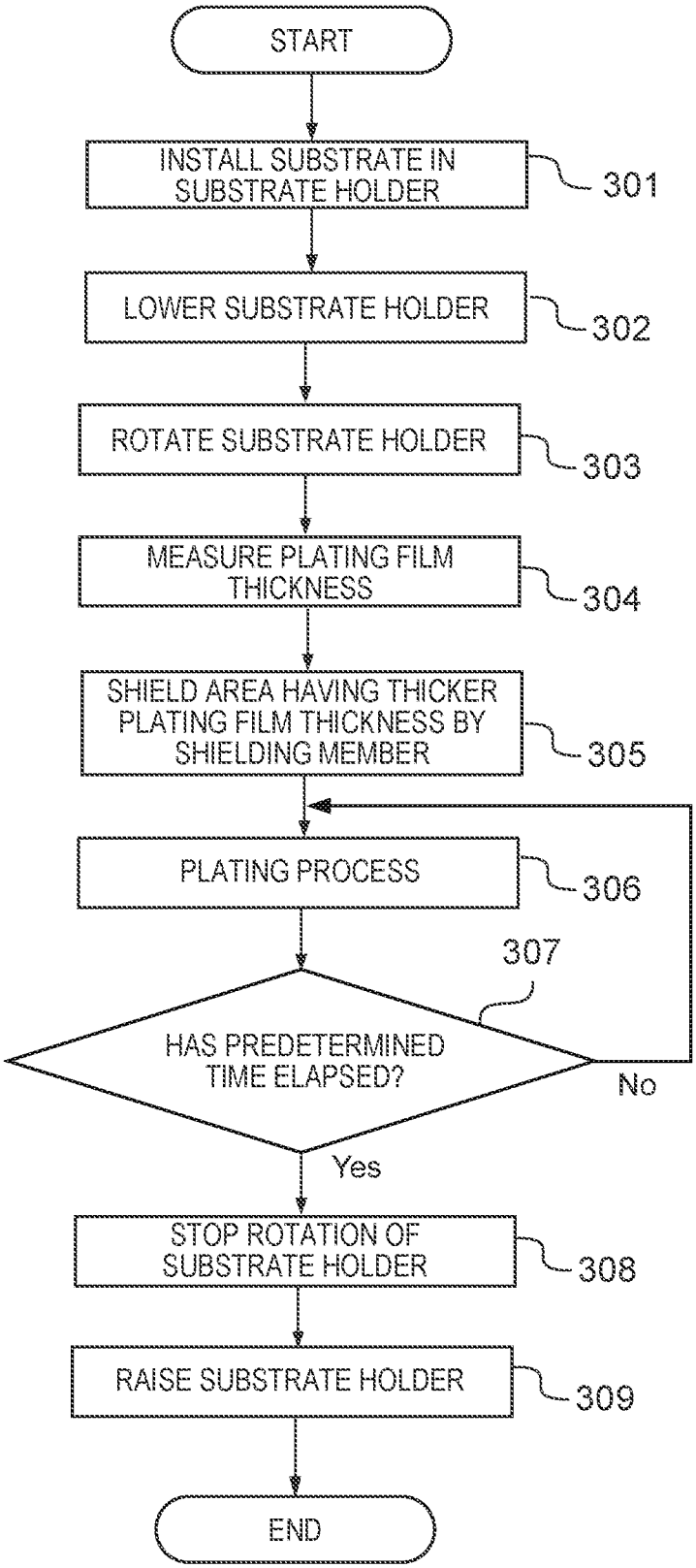
FIG. 27 is a flowchart of a plating method using a plating module of one embodiment.

Next, a plating method using the plating module 400 illustrated in FIG. 26 will be described. FIG. 27 is a flowchart of the plating method using a plating module of one embodiment.

In the plating method of this embodiment, first, the substrate Wf is installed in the substrate holder 440 (step 301). The step 301 can be performed by, for example, placing the substrate Wf with the surface to be plated Wf-a facing downward on the seal ring holder 442 with a robot hand (not illustrated) and the like and pressing the back surface of the substrate Wf by the back plate 444.

Subsequently, in the plating method, the substrate holder 440 is lowered into the plating tank 410 by the elevating mechanism 443 (lowering step 302). Subsequently, in the plating method, the substrate holder 440 is rotated by the rotation mechanism 447 (rotating step 303).

Subsequently, in the plating method, the plating film thickness at the peripheral edge portion of the substrate Wf is measured by the film thickness sensor 498 (measuring step 304). Subsequently, in the plating method, the shielding member 481 is moved between the anode 430 and the substrate Wf based on the plating film thickness at the peripheral edge portion of the substrate Wf by the measuring step 304 (shielding step 305). The shielding step 305 can be performed by the shielding mechanism 499. In the shielding step 305, specifically, when the area having a thicker plating film thickness lies within the predetermined angle range, the shielding member 481 is moved to the shielding position. When the area having a thicker plating film thickness lies outside the predetermined angle range, the shielding member 481 is moved to the retracted position.

Subsequently, in the plating method, w % bile the rotating step 303 to the shielding step 305 continue, the plating process is performed on the surface to be plated Wf-a by applying a voltage between the anode 430 arranged in the plating tank 410 and the substrate Wf held by the substrate holder 440 (plating step 306). Note that, for the plating process (plating step 306) in this embodiment, although the plating process is performed after the substrate Wf is immersed in the plating solution in the plating tank 410, the plating process (plating step 306) may be performed at the time point when at least a part of the substrate Wf is immersed in the plating solution in the plating tank 410.

Subsequently, in the plating method, whether or not the plating process should end is determined (step 307). In the plating method, for example, when it is determined that the plating process should not end because a predetermined time has not elapsed since the plating process started (step 307, No), the process continues by returning to the plating step 306.

On the other hand, in the plating method, for example, when it is determined that the plating process should end because the predetermined time has elapsed since the plating process started (step 307, Yes), the rotation of the substrate holder 440 by the rotation mechanism 447 stops (step 308). Subsequently, in the plating method, the substrate holder 440 is raised by the elevating mechanism 443 (step 309) and the plating process ends.

With the plating method of this embodiment, since the area having a thicker plating film thickness of the substrate Wf can be covered by the shielding member 481, the plating film thickness at the peripheral edge portion of the substrate Wf can be made uniform.

Several embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements described in the claims and specification in a range in which at least a part of the above-described problems can be solved, or a range in which at least a part of the effects can be exhibited.

This application, as one embodiment, discloses a plating apparatus that includes a plating tank for housing a plating solution, an anode arranged in the plating tank, a substrate holder for holding a substrate with a surface to be plated facing downward, a rotation mechanism for rotating the substrate holder, and a shielding mechanism configured to move a shielding member into between the anode and the substrate depending on a rotation angle of the substrate holder. The shielding mechanism includes a cam member, a rotation drive mechanism configured to rotate the cam member, and a driven member configured to push out the shielding member to a shielding position between the anode and the substrate in association with a rotation of the cam member.

Further, this application, as one embodiment, discloses the plating apparatus, in which the cam member includes a cam main body configured to rotate by the rotation drive mechanism and a rotor attached to the cam main body, and the driven member includes a driven slider having a cam groove in which the rotor fits, the driven slider being configured to linearly move the shielding member between the shielding position and a retracted position by pushing with the rotor in association with a rotation of the cam main body, the retracted position being apart from between the anode and the substrate.

Further, this application, as one embodiment, discloses the plating apparatus, in which the shielding mechanism further includes a belt wound around a first pulley and a second pulley, the cam member includes an eccentric cam member coupled to the second pulley, the rotation drive mechanism is configured to rotate the eccentric cam member by rotating the first pulley, and the driven member includes a driven cam member configured to push out the shielding member to the shielding position by pushing with a protrusion of the eccentric cam member.

Further, this application, as one embodiment, discloses the plating apparatus that includes a plating tank for housing a plating solution, an anode arranged in the plating tank, a substrate holder for holding a substrate with a surface to be plated facing downward, a rotation mechanism for rotating the substrate holder, and a shielding mechanism configured to move a shielding member into between the anode and the substrate depending on a rotation angle of the substrate holder. The shielding mechanism includes a linear motion drive mechanism configured to linearly move the shielding member between a shielding position and a retracted position, the shielding position being between the anode and the substrate, the retracted position being apart from between the anode and the substrate.

Further, this application, as one embodiment, discloses the plating apparatus, in which the shielding member includes a mask member having an arc shape corresponding to a part of a peripheral edge portion of an arc-shaped substrate.

Further, this application, as one embodiment, discloses the plating apparatus that includes a plating tank for housing a plating solution, an anode arranged in the plating tank, a substrate holder for holding a substrate with a surface to be plated facing downward, a rotation mechanism for rotating the substrate holder, a film thickness sensor configured to measure a plating film thickness of the substrate, and a shielding mechanism configured to move a shielding member to a shielding position between the anode and the substrate based on a plating film thickness of the substrate measured by the film thickness sensor.

Further, this application, as one embodiment, discloses a plating method comprising a lowering step of lowering a substrate holder holding a substrate into a plating tank with a surface to be plated facing downward, a rotating step of rotating the substrate holder, a measuring step of measuring a plating film thickness of the substrate, a shielding step of moving a shielding member into between an anode and the substrate based on the plating film thickness of the substrate measured by the measuring step, and a plating step of performing a plating process on the surface to be plated by applying a voltage between the anode arranged in the plating tank and the substrate held by the substrate holder.

Further, this application, as one embodiment, discloses a plating apparatus that includes a plating tank for housing a plating solution, an anode arranged in the plating tank, a substrate holder for holding a substrate with a surface to be plated facing downward, a rotation mechanism for rotating the substrate holder, and a shielding mechanism configured to move a shielding member into between the anode and the substrate depending on a rotation angle of the substrate holder. The shielding mechanism includes a cam member attached to the substrate holder, and a driven link configured to push out the shielding member into between the anode and the substrate in response to pushing by a protrusion of the cam member.

Further, this application, as one embodiment, discloses the plating apparatus, in which the cam member has a plurality of protrusions, and the driven link is configured to push out the shielding member into between the anode and the substrate every time the driven link is pressed by the plurality of protrusions.

Further, this application, as one embodiment, discloses the plating apparatus, in which the cam member includes a disc cam, and the driven link includes a follower configured to be pushed by a protrusion of the disc cam to move to a direction moving away from the substrate holder, a link configured to rotate in response to pushing by the follower to push out the shielding member into between the anode and the substrate, and a pressing member configured to push the shielding member back to a direction moving away from between the anode and the substrate when the shielding member is not pushed out by the link.

Further, this application, as one embodiment, discloses the plating apparatus, in which the disc cam includes a main body member attached to the substrate holder and a protrusion member attachably/detachably attached to the main body member.

Further, this application, as one embodiment, discloses the plating apparatus, in which the shielding mechanism is configured to push out the shielding member into between the anode and a specific portion of the substrate when the specific portion of the substrate rotates within a predetermined angle range.

Further, this application, as one embodiment, discloses the plating apparatus, in which the specific portion is a notch of the substrate, and the shielding member is configured to cover the notch of the substrate and a specific region around the notch of the substrate when the shielding member is pushed out into between the anode and the notch of the substrate by the shielding mechanism.

Further, this application, as one embodiment, discloses the plating apparatus, in which the specific region around the notch of the substrate includes a region in which a pattern around the notch of the substrate is not formed.

Further, this application, as one embodiment, discloses the plating apparatus, in which a plurality of the shielding mechanisms are disposed along a circumferential direction of the plating tank.

Further, this application, as one embodiment, discloses a plating method comprising a lowering step of lowering a substrate holder holding a substrate with a surface to be plated facing downward into a plating tank, a rotating step of rotating the substrate holder, a shielding step of moving a shielding member into between an anode and the substrate depending on a rotation angle of the substrate holder by the rotating step, and a plating step of performing a plating process on the surface to be plated by applying a voltage between the anode arranged in the plating tank and the substrate held by the substrate holder. The shielding step includes a step of moving a follower to a direction moving away from the substrate holder by a protrusion of a disc cam attached to the substrate holder, and a step of pushing out the shielding member into between the anode and the substrate by rotating a link in response to pushing by the follower.

Further, this application, as one embodiment, discloses the plating method, in which the shielding step further includes a step of pushing the shielding member back to a direction moving away from between the anode and the substrate when the shielding member is not pushed out into between the anode and the substrate.

Further, this application, as one embodiment, discloses a plating method comprising a step of selecting a protrusion member corresponding to a type of a substrate to be held by the substrate holder from a plurality of protrusion members of the disc cam having different protrusion sizes and attaching the protrusion member to a main body member of the disc cam.

REFERENCE SIGNS LIST

400 . . . plating module
410 . . . plating tank
430 . . . anode
440 . . . substrate holder
442 . . . seal ring holder
443 . . . elevating mechanism
444 . . . back plate
446 . . . frame
447 . . . rotation mechanism
448 . . . shaft
450 . . . ionically resistive element
460 . . . shielding mechanism
461 . . . cam member
462 . . . disc cam
462*a* . . . protrusion
463 . . . main body member
464 . . . protrusion member
464-1 . . . first protrusion member
464-2 . . . second protrusion member
470 . . . driven link
471 . . . first roller
472 . . . base
473 . . . follower
474 . . . link
475 . . . second roller
476 . . . rotation shaft
478 . . . third roller
479 . . . pressing member
481 . . . shielding member
481*a* . . . mask member
482 . . . shielding member
484 . . . flange
485 . . . shielding mechanism
486 . . . rotation drive mechanism
487 . . . cam member
487*a* . . . rotor
487*b* . . . cam main body
488 . . . driven member
489 . . . driven slider
489*a* . . . cam groove
491 . . . rotation drive mechanism
492 . . . belt
492-1 . . . first pulley
492-2 . . . second pulley
493 . . . eccentric cam member
493*b* . . . protrusion
494 . . . driven cam member
497 . . . linear motion drive mechanism
498 . . . film thickness sensor
499 . . . shielding mechanism
1000 . . . plating apparatus
Wf . . . substrate
Wf-a . . . surface to be plated
Wf-b . . . pattern area
Wf-c . . . non-pattern area
Wf-n . . . notch

What is claimed is:

1. A plating apparatus comprising:
a plating tank for housing a plating solution;
an anode arranged in the plating tank;
a substrate holder for holding a substrate with a surface to be plated facing downward;
a rotation mechanism for rotating the substrate holder; and
a shielding mechanism configured to move a shielding member into between the anode and the substrate depending on a rotation angle of the substrate holder, wherein the shielding mechanism includes:
a cam member;
a rotation drive mechanism configured to rotate the cam member; and
a driven member configured to push out the shielding member to a shielding position between the anode and the substrate in association with a rotation of the cam member.

2. The plating apparatus according to claim 1, wherein
the cam member includes a cam main body configured to rotate by the rotation drive mechanism and a rotor attached to the cam main body, and
the driven member includes a driven slider having a cam groove in which the rotor fits, the driven slider being configured to linearly move the shielding member between the shielding position and a retracted position by pushing with the rotor in association with a rotation of the cam main body, the retracted position being apart from between the anode and the substrate.

3. The plating apparatus according to claim 1, wherein
the shielding mechanism further includes a belt wound around a first pulley and a second pulley,
the cam member includes an eccentric cam member coupled to the second pulley,
the rotation drive mechanism is configured to rotate the eccentric cam member by rotating the first pulley, and
the driven member includes a driven cam member configured to push out the shielding member to the shielding position by pushing with a protrusion of the eccentric cam member.

4. The plating apparatus according to claim 1, wherein
the shielding member includes a mask member having an arc shape corresponding to a part of a peripheral edge portion of an arc-shaped substrate.

5. A plating apparatus comprising:
a plating tank for housing a plating solution;
an anode arranged in the plating tank;
a substrate holder for holding a substrate with a surface to be plated facing downward;
a rotation mechanism for rotating the substrate holder; and
a shielding mechanism configured to move a shielding member into a position between the anode and the substrate depending on a rotation angle of the substrate holder, wherein the shielding mechanism includes a linear motion drive mechanism configured to linearly move the shielding member between a shielding position and a retracted position, the shielding position being between the anode and the substrate, the retracted position being apart from between the anode and the substrate, wherein the shielding mechanism is configured to move the shielding member to the shielding position when a non-pattern area of the substrate rotates within a predetermined angle range, the non-pattern area of the substrate is shielded by the shielding member when the shielding member is in the shielding position.

6. A plating apparatus comprising:

a plating tank for housing a plating solution;

an anode arranged in the plating tank;

a substrate holder for holding a substrate with a surface to be plated facing downward;

a rotation mechanism for rotating the substrate holder;

a film thickness sensor configured to measure a plating film thickness of the substrate; and a shielding mechanism configured to move a shielding member to a shielding position between the anode and the substrate based on a plating film thickness of the substrate measured by the film thickness sensor, wherein the shielding mechanism configured to move the shielding member to the shielding position when a non-pattern area of the substrate rotates within a predetermined angle range, the non-pattern area of the substrate is shielded by the shielding member when the shielding member is in the shielding position.

7. A plating method comprising:

a lowering step of lowering a substrate holder holding a substrate into a plating tank with a surface to be plated facing downward;

a rotating step of rotating the substrate holder;

a measuring step of measuring a plating film thickness of the substrate;

a shielding step of moving a shielding member from a first position into a second position between an anode and the substrate based on the plating film thickness of the substrate measured by the measuring step; and a plating step of performing a plating process on the surface to be plated by applying a voltage between the anode arranged in the plating tank and the substrate held by the substrate holder, wherein the shielding step moving the shielding member from the first position to the second position into of moving the shielding member to a shielding position occurs when a non-pattern area of the substrate rotates within a predetermined angle range, wherein the non-pattern area of the substrate is shielded by the shielding member when the shielding member is in the shielding position.

8. A plating apparatus comprising:

a plating tank for housing a plating solution;

an anode arranged in the plating tank;

a substrate holder for holding a substrate with a surface to be plated facing downward;

a rotation mechanism for rotating the substrate holder; and a shielding mechanism configured to move a shielding member into between the anode and the substrate depending on a rotation angle of the substrate holder, wherein the shielding mechanism includes:

a cam member attached to the substrate holder; and a driven link configured to push out the shielding member into between the anode and the substrate in response to pushing by a protrusion of the cam member.

9. The plating apparatus according to claim 8, wherein the cam member has a plurality of protrusions, and the driven link is configured to push out the shielding member into between the anode and the substrate every time the driven link is pressed by the plurality of protrusions.

10. The plating apparatus according to claim 8, wherein the cam member includes a disc cam, and the driven link includes:

a follower configured to be pushed out by a protrusion of the disc cam to move to a direction moving away from the substrate holder;

a link configured to rotate in response to pushing by the follower to push out the shielding member into between the anode and the substrate; and a pressing member configured to push the shielding member back to a direction moving away from between the anode and the substrate when the shielding member is not pushed out by the link.

11. The plating apparatus according to claim 10, wherein the disc cam includes a main body member attached to the substrate holder and a protrusion member attachably/detachably attached to the main body member.

12. The plating apparatus according to claim 8, wherein the shielding mechanism is configured to push out the shielding member into between the anode and a specific portion of the substrate when the specific portion of the substrate rotates within a predetermined angle range.

13. The plating apparatus according to claim 12, wherein the specific portion is a notch of the substrate, and the shielding member is configured to cover the notch of the substrate and a specific region around the notch of the substrate when the shielding member is pushed out into between the anode and the notch of the substrate by the shielding mechanism.

14. The plating apparatus according to claim 13, wherein the specific region around the notch of the substrate includes a region in which a pattern around the notch of the substrate is not formed.

15. The plating apparatus according to claim 8, wherein a plurality of the shielding mechanisms are disposed along a circumferential direction of the plating tank.

16. A plating method comprising:

a lowering step of lowering a substrate holder holding a substrate with a surface to be plated facing downward into a plating tank;

a rotating step of rotating the substrate holder;

a shielding step of moving a shielding member into between an anode and the substrate depending on a rotation angle of the substrate holder by the rotating step; and a plating step of performing a plating process on the surface to be plated by applying a voltage between the anode arranged in the plating tank and the substrate held by the substrate holder, wherein the shielding step includes a step of moving a follower to a direction moving away from the substrate holder by a protrusion of a disc cam attached to the substrate holder, and a step of pushing out the shielding member into between the anode and the substrate by rotating a link in response to pushing by the follower.

17. The plating method according to claim 16, wherein the shielding step further includes a step of pushing the shielding member back to a direction moving away from between the anode and the substrate when the shielding member is not pushed out into between the anode and the substrate.

18. The plating method according to claim 17, further comprising:

a step of selecting a protrusion member corresponding to a type of a substrate to be held by the substrate holder from a plurality of protrusion members of the disc cam having different protrusion sizes and attaching the protrusion member to a main body member of the disc cam.

* * * * *